US005179241A

United States Patent [19]

Okuda et al.

[11] Patent Number: 5,179,241

[45] Date of Patent: Jan. 12, 1993

[54] APPARATUS FOR DETERMINING TONALITY FOR CHORD PROGRESSION

[75] Inventors: Hiroko Okuda, Kokubunji; Junichi Minamitaka, Fussa, both of Japan

[73] Assignee: Casio Computer Co., Ltd., Tokyo, Japan

[21] Appl. No.: 681,085

[22] Filed: Apr. 5, 1991

[30] Foreign Application Priority Data

Apr. 9, 1990 [JP] Japan ..... 2-92040
Apr. 9, 1990 [JP] Japan ..... 2-92041

[51] Int. Cl.[5] ..... G10H 1/18; G10H 1/38; G10H 7/00

[52] U.S. Cl. ..... 84/613; 84/637; 84/669; 84/DIG. 22

[58] Field of Search ..... 84/610, 613, 615, 624, 84/634, 637, 650, 553, 666, 669, 715, DIG. 22

[56] References Cited

U.S. PATENT DOCUMENTS 4,982,643 1/1991 Minamitaka .
5,003,860 4/1991 Minamitaka .
5,052,267 10/1999 Ino ..... 84/613
5,056,401 10/1991 Yamaguchi et al. ..... 84/637
5,088,380 2/1992 Minamitaka ..... 84/637

FOREIGN PATENT DOCUMENTS 2-29787 1/1990 Japan .
2-29788 1/1990 Japan .
2-29789 1/1990 Japan .
2-29791 1/1990 Japan .
2-29792 1/1990 Japan .
2-29793 1/1990 Japan .
2-83591 3/1990 Japan .

*Primary Examiner*—William M. Shoop, Jr.
*Assistant Examiner*—Helen Kim
*Attorney, Agent, or Firm*—Frishauf, Holtz, Goodman & Woodward

[57] ABSTRACT

A tonality determining apparatus provides a tonality analysis of a chord progression. The apparatus includes a chord function knowledge database storing musical knowledge of evaluating a function of each chord in the chord progression. A keynote and function progression extractor determines a keynote and function of each chord in the chord progression from a chord progression input device in accordance with the function knowledge database. From the extractor's results a tonality data generator produces tonality data defining a pitch class set available in each chord time interval. The tonality determining apparatus is applied to an accompaniment apparatus for playing an accompaniment with a desired tonality.

32 Claims, 44 Drawing Sheets

CKT

| ADDRESS | MEMBER DATA | INDICATE | |
|---|---|---|---|
| 0 | 0 | ROOT | MAJOR |
| 1 | 4 | MAJOR THIRD | |
| 2 | 7 | PERFECT FIFTH | |
| 3 | 15 | DUMMY | |
| 4 | 0 | ROOT | 6th |
| 5 | 4 | MAJOR THIRD | |
| 6 | 7 | PERFECT FIFTH | |
| 7 | 9 | MAJOR SIXTH | |

FIG. 5

| TYPE | DATA |
|---|---|
| MAJOR | 0 |
| 6th | 1 |
| ADD 9th | 2 |
| minor 6th | 3 |
| minor Add 9th | 4 |
| MAJOR 7th | 5 |
| minor | 6 |
| minor7th | 7 |
| minor MAJOR 7th | 8 |
| 7th | 9 |
| 7th#5 | 10 |
| 7thb5 | 11 |
| minor 7thb5 | 12 |
| 7th sus 4 | 13 |
| S/D | 14 |
| 9th | 15 |
| 7th#9th | 16 |
| 7thb9th | 17 |
| Aug. | 18 |
| dim. | 19 |
| sus4 | 20 |

FIG. 6

| DATA EXAMPLES | | | INDICATE |
|---|---|---|---|
| CDN | 0 | 0 | C MAJOR |
| FDN | 2 | 0 | II MAJOR |
| TDN | 0 | 0 | C IONIAN |
| TDN | 15 | | KEY UNDETERMINED |

TDK

| ADDRESS | DATA (KEYNOTE) | DATA (SCALE) | COMMENT |
|---|---|---|---|
| 0 | | | DOMINANT |
| 1 | | | SUBDOMINANT |
| 2 | | | DOMINANT OF DOMINANT |
| 3 | | | SUBDOMINANT OF SUBDOMINANT |

FDK

| ADDRESS | DATA (DEGREE) | DATA (TYPE) | COMMENT |
|---|---|---|---|
| 0 | | | NEW CHORD FUNCTION IN DOMINANT KEY |
| 1 | | | OLD CHORD FUNCTION IN DOMINANT KEY |
| 2 | | | NEW CHORD FUNCTION IN SUBDOMINANT KEY |
| 3 | | | OLD CHORD FUNCTION IN SUBDOMENANT KEY |
| 4 | | | NEW CHORD FUNCTION IN D OF D KEY |
| 5 | | | OLD CHORD FUNCTION IN D OF D KEY |
| 6 | | | NEW CHORD FUNCTION IN S OF S KEY |
| 7 | | | OLD CHORD FUNCTION IN S OF S KEY |

I

FIG. 7B

OFT

| ADDR | DATA | | INDICATE |
|---|---|---|---|
| | DEG | TYPE | |
| 0 | 0 | 0 | I |
| 1 | 0 | 1 | I 6 |
| 2 | 0 | 5 | I M7 |
| 3 | 0 | 2 | I add9 |
| 4 | 2 | 6 | IIm |
| 5 | 2 | 3 | IIm6 |
| 6 | 2 | 7 | IIm7 |
| 7 | 4 | 6 | IIIm |
| 8 | 4 | 7 | IIIm7 |
| 9 | 5 | 0 | IV |
| 10 | 5 | 1 | IV6 |
| 11 | 5 | 5 | IVM7 |
| 12 | 7 | 0 | V |
| 13 | 7 | 1 | V6 |
| 14 | 7 | 9 | V7 |
| 15 | 7 | 10 | V7#5 |
| 16 | 7 | 11 | V7b5 |
| 17 | 7 | 15 | V9 |
| 18 | 7 | 16 | V7#9 |
| 19 | 7 | 17 | V7b9 |
| 20 | 7 | 13 | V7sus4 |
| 21 | 7 | 14 | S/D |
| 22 | 9 | 6 | VIm |
| 23 | 9 | 3 | VIm6 |
| 24 | 9 | 7 | VIm7 |
| 25 | 9 | 8 | VImM7 |
| 26 | 9 | 4 | VImadd9 |
| 27 | 11 | 12 | VIIm7bD |
| 28 | 15 | — | END MARK |

FIG.11

| ADDR | DATA | | INDICATE |
|---|---|---|---|
| 0 | 0 | 0 | I |
| 1 | 4 | 0 | III |
| 2 | 0 | 1 | I6 |
| 3 | 4 | 0 | III |
| 4 | 0 | 2 | Iadd9 |
| 5 | 4 | 0 | III |
| 6 | 0 | 5 | IM7 |
| 7 | 4 | 0 | III |
| 8 | 2 | 6 | IIm |
| 9 | 4 | 0 | III |
| 10 | 2 | 3 | IIm6 |
| 11 | 4 | 0 | III |
| 12 | 2 | 7 | IIm7 |
| 13 | 4 | 0 | III |
| 14 | 5 | 0 | IV |
| 15 | 4 | 0 | III |
| 16 | 5 | 5 | IVM7 |
| 17 | 4 | 0 | III |
| 18 | 5 | 1 | IV6 |
| 19 | 4 | 0 | III |
| 20 | 7 | 0 | V |
| 21 | 4 | 0 | III |
| 22 | 7 | 1 | V6 |
| 23 | 4 | 0 | III |
| 24 | 9 | 6 | VIm |
| 25 | 4 | 0 | III |
| 26 | 11 | 12 | VIIm7b5 |
| 27 | 4 | 0 | III |
| 28 | 0 | 0 | I |
| 29 | 4 | 9 | III7 |
| 30 | 0 | 1 | I6 |
| 31 | 4 | 9 | III7 |
| 32 | 0 | 2 | Iadd9 |
| 33 | 4 | 9 | III7 |
| 34 | 0 | 5 | IM7 |
| 35 | 4 | 9 | III7 |
| 36 | 2 | 6 | IIm |
| 37 | 4 | 9 | III7 |
| 38 | 2 | 3 | IIm6 |
| 39 | 4 | 9 | III7 |
| 40 | 2 | 7 | IIm7 |
| 41 | 4 | 9 | III7 |
| 42 | 5 | 0 | IV |
| 43 | 4 | 9 | III7 |

MCST

| ADDR | DATA | | INDICATE |
|---|---|---|---|
| 44 | 5 | 5 | IVM7 |
| 45 | 4 | 9 | III7 |
| 46 | 5 | 1 | IV6 |
| 47 | 4 | 9 | III7 |
| 48 | 7 | 0 | V |
| 49 | 4 | 9 | III7 |
| 50 | 7 | 1 | V6 |
| 51 | 4 | 9 | III7 |
| 52 | 9 | 6 | VIm |
| 53 | 4 | 9 | III7 |
| 54 | 11 | 12 | VIIm7b5 |
| 55 | 4 | 9 | III7 |
| 56 | 0 | 0 | I |
| 57 | 4 | 13 | III7sus4 |
| 58 | 0 | 1 | I6 |
| 59 | 4 | 13 | III7sus4 |
| 60 | 0 | 2 | Iadd9 |
| 61 | 4 | 13 | III7sus4 |
| 62 | 0 | 5 | IM7 |
| 63 | 4 | 13 | III7sus4 |
| 64 | 2 | 6 | IIm |
| 65 | 4 | 13 | III7sus4 |
| 66 | 2 | 3 | IIm6 |
| 67 | 4 | 13 | III7sus4 |
| 68 | 2 | 7 | IIm7 |
| 69 | 4 | 13 | III7sus4 |
| 70 | 5 | 0 | IV |
| 71 | 4 | 13 | III7sus4 |
| 72 | 5 | 5 | IVM7 |
| 73 | 4 | 13 | III7sus4 |
| 74 | 5 | 1 | IV6 |
| 75 | 4 | 13 | III7sus4 |
| 76 | 7 | 0 | V |
| 77 | 4 | 13 | III7sus4 |
| 78 | 7 | 1 | V6 |
| 79 | 4 | 13 | III7sus4 |
| 80 | 9 | 6 | VIm |
| 81 | 4 | 13 | III7sus4 |
| 82 | 11 | 12 | VIIm7b5 |
| 83 | 4 | 13 | III7sus4 |
| 84 | 15 | — | ENDMARK |

FORMAT

| | | |
|---|---|---|
| EVEN ADDRESS | DEGREE OF OLD CHORD | TYPE OF OLD CHORD |
| ODD ADDRESS | DEGREE OF NEW CHORD | TYPE OF NEW CHORD |

FIG.13

PDB

| ADDRESS | DATA | | INDICATE |
|---|---|---|---|
| | DEG | TYPE | |
| 0 | 0 | 0 | I |
| 1 | 2 | 6 | IIm |
| 2 | 4 | 6 | IIIm |
| 3 | 5 | 0 | IV |
| 4 | 7 | 0 | V |
| 5 | 9 | 6 | VIm |

FIG.15

MDB

| ADDRESS | DATA | | INDICATE |
|---|---|---|---|
| | DEG | TYPE | |
| 0 | 0 | 0 | I |
| 1 | 2 | 6 | IIm |
| 2 | 4 | 6 | IIIm |
| 3 | 5 | 0 | IV |
| 4 | 7 | 0 | V |
| 5 | 9 | 6 | VIm |
| 6 | 11 | 21 | VII-5 |

FIG.16

CFR

| ADDR (TYPE) | DATA (FUNC) | COMMENT |
|---|---|---|
| 0 | 0 | IMAJOR |
| 1 | 0 | I6th |
| 2 | 0 | Iadd9th |
| 3 | 9 | VImimor6th |
| 4 | 0 | Imadd9th |
| 5 | 0 | IMAJOR7th |
| 6 | 9 | VIminor |
| 7 | 2 | IIminor7th |
| 8 | 9 | VIminorMAJOR7th |
| 9 | 7 | V7th |
| 10 | 7 | V7th#5 |
| 11 | 7 | V7thb5 |
| 12 | 11 | VIIminor7thb5 |
| 13 | 7 | V7thsus4 |
| 14 | 7 | S/D |
| 15 | 7 | V9th |
| 16 | 7 | V7th#9th |
| 17 | 7 | V7thb9th |
| 18 | 0 | Aug(KEY INDEPENDENT) |
| 19 | 0 | dim(KEY INDEPENDENT) |
| 20 | 0 | SUS4(KEY INDEPENDENT) |

FIG.19

| ADDR | DATA | | INDICATE |
|---|---|---|---|
| 0 | 0 | 0 | I |
| 1 | 0 | — | IONIAN |
| 2 | 4 | 0 | III |
| 3 | 2 | — | MIXOLYDIAN |
| 4 | 5 | 0 | IV |
| 5 | 1 | — | LYDIAN |
| 6 | 7 | 0 | V |
| 7 | 2 | — | MEXOLUDIAN |
| 8 | 0 | 1 | I6 |
| 9 | 0 | — | IONIAN |
| 10 | 5 | 1 | IV6 |
| 11 | 1 | — | LYDIAN |
| 12 | 7 | 1 | V6 |
| 13 | 2 | — | MIXOLYDIAN |
| 14 | 0 | 5 | IM7 |
| 15 | 0 | — | IONIAN |
| 16 | 5 | 5 | IVM7 |
| 17 | 1 | — | LYDIAN |
| 18 | 0 | 4 | IMadd9 |
| 19 | 0 | — | IONIAN |
| 20 | 2 | 6 | IIm |
| 21 | 3 | — | DORIAN |
| 22 | 4 | 6 | IIIm |
| 23 | 4 | — | PHRYGIAN |
| 24 | 9 | 6 | VIm |
| 25 | 5 | — | MELODIC MINOR |
| 26 | 2 | 3 | IIm6 |
| 27 | 3 | — | DORIAN |
| 28 | 9 | 3 | VIm6 |
| 29 | 5 | — | MELODIC MINOR |
| 30 | 2 | 7 | IIm7 |
| 31 | 3 | — | DORIAN |
| 32 | 4 | 7 | IIIm7 |
| 33 | 4 | — | PHRYGIAN |
| 34 | 9 | 7 | VIm7 |
| 35 | 6 | — | AEORIAN |
| 36 | 11 | 12 | VIIm7b5 |
| 37 | 7 | — | LO CRIAN |
| 38 | 9 | 8 | VImM7 |
| 39 | 5 | — | MELODIC MINOR |
| 40 | 9 | 4 | VImadd9 |
| 41 | 5 | — | MELODIC MINOR |

SCT

| ADDR | DATA | | INDICATE |
|---|---|---|---|
| 42 | 4 | 9 | III7 |
| 43 | 2 | — | MIXOLY DIAN |
| 44 | 7 | 9 | V7 |
| 45 | 2 | — | MEXOLY DIAN |
| 46 | 7 | 13 | V7sus4 |
| 47 | 2 | — | MIXOLY DIAN |
| 48 | 7 | 10 | V7#5 |
| 49 | 8 | — | MELODIC MINOR 5th below |
| 50 | 7 | 11 | V7b5 |
| 51 | 9 | — | LYDIAN 7th |
| 52 | 7 | 15 | V9 |
| 53 | 2 | — | MIXOLY DIAN |
| 54 | 7 | 16 | V7th#9th |
| 55 | 10 | — | ALTERED |
| 56 | 7 | 17 | V7thb9th |
| 57 | 11 | — | HARMONIC MENOR 5th below |
| 58 | 7 | 14 | V S/D |
| 59 | 2 | — | MEXOLY DIAN |
| 60 | 14 | 18 | KEY INDEPENDENT Aug |
| 61 | 12 | — | whole tone |
| 62 | 14 | 19 | KEY INDEPENDENT dim |
| 63 | 13 | — | Diminished |
| 64 | 14 | 20 | KEY INDEPENDENT sus4 |
| 65 | 14 | — | sus4 |
| 66 | 15 | — | END MARK |

FORMAT

| | | |
|---|---|---|
| EVEN ADDRESS | DEGREE | TYPE |
| ODD ADDRESS | SCALE | NOT USED |

FIG. 21

SKT

| ADDRESS | DATA | INDICATE | |
|---|---|---|---|
| 0 | 0 | C | IONIAN SCALE |
| 1 | 2 | D | |
| 2 | 4 | E | |
| 3 | 5 | F | |
| 4 | 7 | G | |
| 5 | 9 | A | |
| 6 | 11 | B | |
| 7 | 15 | DUMMY | |
| 8 | 5 | F | LYDIAN SCALE |
| 9 | 7 | G | |
| 10 | 9 | A | |
| 11 | 11 | B | |
| 12 | 0 | C | |
| 13 | 2 | D | |
| 14 | 4 | E | |
| 15 | 15 | DUMMY | |
| 16 | 7 | G | MIXOLYDIAN SCALE |
| 17 | 9 | A | |
| 18 | 11 | B | |
| 19 | 0 | C | |
| 20 | 2 | D | |
| 21 | 4 | E | |

FIG. 23

| SCALE NAME | DATA |
|---|---|
| IONIAN | 0 |
| LYDIAN | 1 |
| MIXOLYDIAN | 2 |
| DORIAN | 3 |
| RHRYGIAN | 4 |
| MELODIC MINOR | 5 |
| AEORIAN | 6 |
| LOCRIAN | 7 |
| MELODIC MINOR 5th below | 8 |
| LYDIAN 7th | 9 |
| ALTERED | 10 |
| HARMONIC MINOR 5th below | 11 |
| whole tone | 12 |
| diminished | 13 |
| sus4 | 14 |

FIG.24

| ADDR | PITCH AMP | POINTER AMT |
|---|---|---|
| 0 | C5 | 0 |
| 1 | | |
| 2 | E5 | 1 |
| 3 | | |
| 4 | B4 | 2 |
| 5 | | |
| 6 | E5 | 1 |
| 7 | | |
| 8 | A4 | 3 |
| 9 | | |
| 10 | E5 | 1 |
| 11 | | |
| 12 | B4 | 2 |
| 13 | | |
| 14 | E5 | 1 |
| 15 | | |

AM

FIG. 27

| | 0 | 1 | 2 | 3 | 4 | 5 | 6 | 7 | 8 | 9 | 10 | 11 | 12 | 13 |
|---|---|---|---|---|---|---|---|---|---|---|---|---|---|---|
| Major I | 0 | 0 | 0 | 0 | | | | | | | | | | 0 |
| Major II | 0 | 0 | 0 | 0 | | | | | | | | | | 0 |
| Major III | 0 | 0 | 0 | 0 | | | | | | | | | | 0 |
| Major IV | 0 | +1 | 0 | 0 | | | | | | | | | | 0 |
| Major V | -1 | -2 | -2 | -2 | | | | | | | | | | 0 |
| 6thI | 0 | 0 | 0 | | | | | | | | | | | 0 |
| 6thIV | 0 | 0 | 0 | | | | | | | | | | | 0 |
| 6th V | 0 | 0 | 0 | | | | | | | | | | | 0 |
| Majot7thI | 0 | 0 | 0 | | | | | | | | | | | 0 |
| Major7thIV | 0 | 0 | 0 | | | | | | | | | | | 0 |
| Add9th | 0 | 0 | 0 | | | | | | | | | | | 0 |
| mimor II | 0 | -1 | 0 | | | | | | | | | | | 0 |
| minor III | 0 | -1 | 0 | | | | | | | | | | | 0 |
| minor VI | 0 | -1 | 0 | | | | | | | | | | | 0 |
| minor6th II | 0 | -1 | 0 | | | | | | | | | | | 0 |
| minor6th VI | 0 | -1 | 0 | | | | | | | | | | | 0 |
| minor7th II | 0 | -1 | 0 | | | | | | | | | | | 0 |
| minor7th III | 0 | -1 | 0 | | | | | | | | | | | 0 |
| minor7th VI | 0 | -1 | 0 | | | | | | | | | | | 0 |
| madd 9th | 0 | -1 | 0 | | | | | | | | | | | 0 |
| 7th III | 0 | 0 | 0 | | | | | | | | | | | 0 |
| 7th V | 0 | 0 | 0 | | | | | | | | | | | 0 |
| 9th | 0 | 0 | 0 | | | | | | | | | | | 0 |
| b9th | 0 | 0 | 0 | | | | | | | | | | | 0 |
| #9th | 0 | 0 | 0 | | | | | | | | | | | 0 |
| IIm7/BassV | 0 | -1 | 0 | | | | | | | | | | | -7 |
| IV/BassV | 0 | 0 | 0 | | | | | | | | | | | -7 |
| m7b5 | 0 | -1 | -1 | | | | | | | | | | | 0 |
| mM7th | 0 | -1 | 0 | | | | | | | | | | | 0 |
| 7th#5 | 0 | 0 | 1 | | | | | | | | | | | 0 |
| 7Sus4 | 0 | 1 | 0 | | | | | | | | | | | 0 |
| Sus4 | 0 | 1 | 0 | | | | | | | | | | | 0 |
| Aug | 0 | 0 | 1 | | | | | | | | | | | 0 |
| dim | 0 | -1 | -1 | | | | | | | | | | | 0 |

PCT

FIG.28

| | | | | | | |
|---|---|---|---|---|---|---|
| I | | | IM7 | | | IIm7b5 |
| IIm | | IIm7 | | | | |
| IIIm | III | IIIm7 | III7 | | III7sus4 | |
| IV | IVm | | IVM7 | IVmM7 | | |
| V | | | V7 | | V7sus4 | |
| VIm | | VIm7 | | VImM7 | | |
| VIIm7b5 | | | | | | |

DOFT

FIG. 33

| FUNC NAME | 0 | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|---|
| Major I | 0 | 0 | 0 | 0 | | | | | | | | | | | | | |
| Major II | | | | | | | | | | | | | | | | | |
| Major IV | 0 | 1 | 0 | 0 | | | | | | | | | | | | | |
| Major V | -1 | -2 | -2 | -2 | | | | | | | | | | | | | |
| 6thI | | | | | | | | | | | | | | | | | |
| 6thIV | | | | | | | | | | | | | | | | | |
| 6thV | | | | | | | | | | | | | | | | | |
| Majot7thI | | | | | | | | | | | | | | | | | |
| Major7thIV | | | | | | | | | | | | | | | | | |
| Add9th | | | | | | | | | | | | | | | | | |
| mimor II | | | | | | | | | | | | | | | | | |
| minor III | | | | | | | | | | | | | | | | | |
| minor VI | | | | | | | | | | | | | | | | | |
| minor 6th II | | | | | | | | | | | | | | | | | |
| minor 6th VI | | | | | | | | | | | | | | | | | |
| minor 7th II | | | | | | | | | | | | | | | | | |
| minor 7th III | | | | | | | | | | | | | | | | | |
| minor 7th VI | | | | | | | | | | | | | | | | | |
| madd 9th | | | | | | | | | | | | | | | | | |
| 7th III | | | | | | | | | | | | | | | | | |
| 7th V | | | | | | | | | | | | | | | | | |
| 9th V | | | | | | | | | | | | | | | | | |
| b9thV | | | | | | | | | | | | | | | | | |
| mM 7th IV | | | | | | | | | | | | | | | | | |
| mM 7th VI | | | | | | | | | | | | | | | | | |
| 7Sus4 III | | | | | | | | | | | | | | | | | |
| 7Sus4 V | | | | | | | | | | | | | | | | | |
| Sus4 I | | | | | | | | | | | | | | | | | |
| Sus4 II | | | | | | | | | | | | | | | | | |
| Sus4 III | | | | | | | | | | | | | | | | | |
| Sus4 V | | | | | | | | | | | | | | | | | |
| Sus4VI | | | | | | | | | | | | | | | | | |
| Aug I | 0 | 0 | -3 | 1 | | | | | | | | | | | | | |
| Aug I# | 1 | 1 | -2 | 2 | | | | | | | | | | | | | |
| Aug II | -2 | -2 | -3 | -3 | | | | | | | | | | | | | |
| Aug II# | | | | | | | | | | | | | | | | | |
| Aug III | | | | | | | | | | | | | | | | | |
| Aug IV | | | | | | | | | | | | | | | | | |
| Aug IV# | | | | | | | | | | | | | | | | | |
| Aug V | | | | | | | | | | | | | | | | | |
| Aug V# | | | | | | | | | | | | | | | | | |
| Aug VI | | | | | | | | | | | | | | | | | |
| Aug VI# | | | | | | | | | | | | | | | | | |
| Aug VII | | | | | | | | | | | | | | | | | |
| dim I | | | | | | | | | | | | | | | | | |
| dim I# | | | | | | | | | | | | | | | | | |
| dim II | | | | | | | | | | | | | | | | | |
| dim II# | | | | | | | | | | | | | | | | | |
| dim III | | | | | | | | | | | | | | | | | |
| dim IV | | | | | | | | | | | | | | | | | |
| dim IV# | | | | | | | | | | | | | | | | | |
| dim V | | | | | | | | | | | | | | | | | |
| dim V# | | | | | | | | | | | | | | | | | |
| dim VI | | | | | | | | | | | | | | | | | |
| dim VI# | | | | | | | | | | | | | | | | | |
| dim VII | | | | | | | | | | | | | | | | | |

KPCT

FIG. 37

| | 0 | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|---|
| Major I | 0 | 0 | 0 | 0 | | | | | | | | | | | | | |
| Major III | | | | | | | | | | | | | | | | | |
| Major IV | 0 | 1 | 0 | 0 | | | | | | | | | | | | | |
| Major V | -1 | -2 | -2 | -2 | | | | | | | | | | | | | |
| 6th I | | | | | | | | | | | | | | | | | |
| 6th IV | | | | | | | | | | | | | | | | | |
| 6th V | | | | | | | | | | | | | | | | | |
| Majot 7th I | | | | | | | | | | | | | | | | | |
| Major 7th IV | | | | | | | | | | | | | | | | | |
| Add9th | | | | | | | | | | | | | | | | | |
| minor II | | | | | | | | | | | | | | | | | |
| minor III | | | | | | | | | | | | | | | | | |
| minor VI | | | | | | | | | | | | | | | | | |
| minor 6th II | | | | | | | | | | | | | | | | | |
| minor 6th VI | | | | | | | | | | | | | | | | | |
| minor 7th II | | | | | | | | | | | | | | | | | |
| minor 7th III | | | | | | | | | | | | | | | | | |
| minor 7th VI | | | | | | | | | | | | | | | | | |
| madd9th | | | | | | | | | | | | | | | | | |
| 7th III | | | | | | | | | | | | | | | | | |
| 7th V | | | | | | | | | | | | | | | | | |
| 9th V | | | | | | | | | | | | | | | | | |
| b9th V | | | | | | | | | | | | | | | | | |
| mM7th IV | | | | | | | | | | | | | | | | | |
| mM7th VI | | | | | | | | | | | | | | | | | |
| 7Sus4 III | | | | | | | | | | | | | | | | | |
| 7Sus4 V | | | | | | | | | | | | | | | | | |
| Sus4 | | | | | | | | | | | | | | | | | |
| Aug | 0 | 0 | -3 | 1 | | | | | | | | | | | | | |
| dim | | | | | | | | | | | | | | | | | |

K/RPCT

FIG. 41

| CHORD NAME | SCALE NAME | 0 | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|---|---|
| Major I | Ionian | 0 | 0 | 0 | 0 | | | | | | | | | | | | | |
| Major III | Melodicminor5below | | | | | | | | | | | | | | | | | |
| Major IV | Lydian | -5 | -4 | -5 | -5 | | | | | | | | | | | | | |
| Major V | Mixolydian | -8 | -9 | -9 | -9 | | | | | | | | | | | | | |
| 6th I | Ionian | | | | | | | | | | | | | | | | | |
| 6th IV | Lydian | | | | | | | | | | | | | | | | | |
| 6th V | Mixolydian | | | | | | | | | | | | | | | | | |
| Majot7thI | Ionian | | | | | | | | | | | | | | | | | |
| Major7thIV | Lydian | | | | | | | | | | | | | | | | | |
| Add9th | Ionian | | | | | | | | | | | | | | | | | |
| minor II | Dorian | | | | | | | | | | | | | | | | | |
| minor III | Phrigian | | | | | | | | | | | | | | | | | |
| minor VI | Melodic minor | | | | | | | | | | | | | | | | | |
| minor6thII | Dorian | | | | | | | | | | | | | | | | | |
| minor6thVI | Melodic minor | | | | | | | | | | | | | | | | | |
| minor7thII | Dorian | | | | | | | | | | | | | | | | | |
| minor7thIII | Phrigian | | | | | | | | | | | | | | | | | |
| minor7thVI | Aeorian | | | | | | | | | | | | | | | | | |
| madd9th | Melodic minor | | | | | | | | | | | | | | | | | |
| 7th III | Melodicminor5below | | | | | | | | | | | | | | | | | |
| 7th V | Mixolydian | | | | | | | | | | | | | | | | | |
| 9th V | Mixolydian | | | | | | | | | | | | | | | | | |
| b9th V | Melodicminor5below | | | | | | | | | | | | | | | | | |
| m7b5 VII | Locrian | | | | | | | | | | | | | | | | | |
| m7b5 II | Melodicminor6below | | | | | | | | | | | | | | | | | |
| mM7th | Melodic minor | | | | | | | | | | | | | | | | | |
| 7Sus4 III | Melodicminor5below | | | | | | | | | | | | | | | | | |
| 7Sus4 V | Mixolydian | | | | | | | | | | | | | | | | | |
| Sus4 | | | | | | | | | | | | | | | | | | |
| dim | Diminished | | | | | | | | | | | | | | | | | |
| Aug | Wholetone | 0 | 0 | -3 | 1 | | | | | | | | | | | | | |

RPCT

FIG. 45

APPARATUS FOR DETERMINING TONALITY FOR CHORD PROGRESSION

BACKGROUND OF THE INVENTION

1. Technical Field

This invention generally relates to musical apparatus. In particular the invention pertains to an apparatus for determining a tonality from a chord progression and to an automatic accompaniment performing apparatus.

2. Description of Prior Art

An electronic musical instrument having an automatic accompaniment performing capability is known. A play input device (e.g., musical keyboard) of the musical instrument is used to successively designate chords each represented by a keycode (note number) combination to provide a chord progression. Within the musical instrument there is provided a chord member memory which stores members of each chord in a chord set. Each stored chord member indicates a pitch interval from a chord root. Assuming that one of a plurality of keycodes (note numbers) entered from the keyboard is a root of the chord designated by the plurality of keycodes, a chord root and type determining means converts each entered keycode to a corresponding pitch interval from that root to obtain designated chord member data comparable with that of the chord member memory. The chord root and type determining means identifies a type and root of a designated chord by finding stored chord member data of a particular chord type that matches the designated chord member data. In this manner, there is formed a chord progression in which each chord is represented by a root and a type. The musical instrument further includes an accompaniment pattern memory storing an accompaniment pattern. The accompaniment pattern comprises horizontal (time) component and vertical (pitch) component of an accompaniment line. An accompaniment decoding means converts the stored vertical data to pitch data indicative of an actual pitch of the accompaniment in accordance with an identified chord type and root.

The musical instrument described above has no capability of evaluating a function of a chord in a chord progression. In general, in music, even if a type and root of a chord is known, this is not enough to determine a tonality i.e., a pitch class set available in the time interval of that chord. By way of example, take up a chord of C major (root=C, type=major) having members of C, E and G. If C major chord has a function of tonic (I), a desired set of pitch classes are C, D, E, F, G, A and B which form an ionian scale in a key of C. If same chord has a function of dominant (V), a set of pitch classes C, D, E, F, G, A and B♭ forming a mixolydian scale in key F may be suitable. In the case when C major chord has a function of subdominant (IV), a desired set of pitch classes will be C, D, E, F♯, G, A and B which form a lydian scale in key G. As noted, it is a nature of music that a specified function as well as specified type and root of a chord is required to determine a desired pitch class set (tonality). Nevertheless, this is disregarded in the musical instrument stated above which instead decodes the stored accompaniment pattern by using only a chord root and type to determine accompaniment pitches. The resultant accompaniment can sound unnatural because of undesirable pitches contained therein that weaken or damage the desired tonality. This may be avoided by restricting vertical contents of the accompaniment to, for example, chord member pitches only. This solution, however, will deprive the accompaniment of musical interest because of its poor pitch contents.

To save storage capacity, a typical prior art automatic accompaniment performing apparatus employs an accompaniment pattern memory which stores an accompaniment pattern only for a single reference chord having a reference root (e.g., C) and a reference type (e.g., major). Typically, vertical pattern element (pitch data) of the stored accompaniment pattern is designed to represent a pitch interval from a chord root. In operation, the pitch interval is modified depending on a detected chord type. Suppose, for example, that the stored accompaniment pattern is written for a chord of C major and includes a pitch data item indicative of a pitch interval of major third from a chord root. If a detected chord type is minor, this pitch data item is lowered by a half tone, thus indicating a minor third from a root. The pitch data item modified by a detected chord type is further modified by a detected chord root to provide an actual pitch in the accompaniment. For a detected root of C, the actual pitch will be E♭ which is minor third degree from the root C. If the detected root is G, the actual accompaniment pitch will be B♭ which is minor third degree from the root G. Therefore, the prior art apparatus of this type has a problem that the pitch line of the accompaniment will change in substantially parallel to the root pitch progression in the chord progression.

U.S. patent application Ser. No. 07/290,295, filed on Dec. 22, 1988, now U.S. Pat. No. 5,003,860, and assigned to the same assignee as the present application discloses a tonality determining apparatus which determines a tonality from a chord progression and an automatic accompaniment performing apparatus which uses the results from the tonality determining means to play an accompaniment. This tonality determining apparatus uses algorithms (programs) rather than data to realize musical knowledge required for determining a tonality. Because of its principles, the tonality determining apparatus provides a tonality with a relatively low reliability. In other words, to obtain an accurate tonality, the tonality determining apparatus of this type would require complicated logic and arithmetic operations consuming a considerable time which would not be permissible in real-time applications such as automatic accompaniment performing apparatus.

Another example of tonality determining apparatus and automatic accompaniment performing apparatus is disclosed in Japanese patent application laid open to public as Kokai Hei2-29787. This tonality determining apparatus searches from a given chord progression for a portion indicative of a specific chord pattern having a particular chord type pattern and a particular chord root difference pattern to determine a key. However, the tonality determining apparatus will never use or reference a key determined already for a preceding portion of the chord progression to determine a key for a succeeding chord in the chord progression. This tends to introduce a delay in detecting a modulation (change of key), resulting in wrong key determination for a portion of the chord progression. Thus, an automatic accompaniment performing apparatus, which is an application of such tonality determining apparatus, cannot hope to perform a satisfactory accompaniment for the reasons stated before.

The automatic accompaniment performing apparatus of the above Japanese patent application Kokai Hei2-29787 includes means for determining a scale from a tonality (from the tonality determining apparatus) and a chord (from a chord progression input device), and an accompaniment pattern memory for storing a plurality of accompaniment patterns each provided for a different one of a plurality of scales. Each accompaniment pattern has a pattern of pitch intervals each from a chord root. In operation, the automatic accompaniment performing apparatus selects and reads from the accompaniment pattern memory an accompaniment pattern corresponding to a determined scale. Then, the apparatus adds a chord root from the chord progression input device to a pitch interval data item in the selected accompaniment pattern to thereby produce a pitch signal of an actual accompaniment tone. Therefore, the automatic accompaniment performing apparatus of this type requires a complicated accompaniment forming system; the accompaniment pattern memory must be provided with a large number of accompaniment patterns written in different keys, imposing a burden on a pattern writer or designer who writes such patterns.

SUMMARY OF THE INVENTION

Therefore, it is an object of the invention to provide a tonality determining apparatus capable of determining, from a progression of chords each represented by a root and a type, a tonality in a time interval of each chord with higher accuracy than that achieved by the prior art.

A specific object of the invention is to provide a tonality determining apparatus capable of determining a tonality from a chord progression without relying on a tonality determining algorithm or chord pattern data of roots and types.

A further object of the invention is to provide a tonality determining apparatus capable of detecting a modulation from a chord progression without any substantial delay.

Another object of the invention is to provide an automatic accompaniment performing apparatus capable of playing an accompaniment with an appropriate tonality by making use of the tonality determining apparatus of the invention.

A still further object of the invention is to provide an automatic accompaniment performing apparatus capable of playing an accompaniment with an appropriate tonality by means of a relatively simple structure.

In accordance with the invention there is provided an apparatus for determining a tonality which comprises: chord progression providing means for providing a chord progression in which each chord is represented by a root and a type; database means for storing a database of musical knowledge for evaluating a function of a chord; analyzing means for analyzing the chord progression based on the database stored in the database means; and tonality data producing means responsive to the analyzing means for producing tonality data defining a set of pitch classes available in a time interval of each chord in the chord progression.

With this arrangement, the apparatus can determine a correct tonality in each chord time interval of the chord progression since it determines a proper function of each chord by the support of musical knowledge stored in the database means. The stored musical knowledge does not take the form of either a program as in one prior art, or chord pattern data of roots and types as in another prior art, but is designed to evaluate chord functions.

In accordance with an aspect of the invention, there is provided an apparatus for determining a tonality which comprises: chord progression providing means for providing a chord progression in which each chord is represented by a root and a type; current keynote storage means for storing keynote data indicative of a current keynote; database means for storing a database of musical knowledge for evaluating a function of a chord; analyzing means for analyzing the chord progression based on the current keynote from the current keynote data storage means and the database means to thereby produce a chord function progression; and tonality data producing means for producing tonality data defining a set of pitch classes available in a time interval of each chord in the chord progression based on the chord function progression from the analyzing means.

This arrangement enables more accurate tonality determination in each chord time interval since it analyzes the chord progression based on both the database and the current keynote which is a preceding keynote for the new chord. In addition, this arrangement enables quick detecting of a modulation when it does occur in the chord progression.

A mode of the tonality determining apparatus of the invention comprises: chord progression providing means for providing a chord progression; current keynote storage means for storing keynote data indicative of a current keynote; same keynote keeping chord table storage means for storing a set of chords each keeping a keynote unchanged; same keynote determining means responsive to a new chord from the chord progression providing means for determining whether the same keynote keeping chord table storage means includes a chord having a function identical with a function of the new chord, the function of the new chord being specified by the keynote data stored in the current keynote storage means, and for generating a keynote keeping signal if the same keynote keeping chord table storage means includes the chord; and tonality data producing means responsive to the keynote keeping signal for producing tonality data defining a set of pitch classes available in a time interval of the new chord based on the current keynote and the new chord.

In this arrangement, whether a new chord from the chord progression has a function of keeping a keynote unchanged is determined by searching through the same keynote keeping chord table storage means for the new chord. If the search has found that the new chord has that function, it will be determined that a keynote in the new chord time interval is the same as the keynote in a time interval preceding the new chord time interval. Then, the apparatus produces tonality data indicative of a pitch class set available in the new chord time interval. In this manner, the apparatus provides a sequence of tonalities suitable for the chord progression from the chord progression per se.

The same keynote keeping chord table storage means may store a set of chords of a minor key each for keeping a key signature unchanged as well as a set of chords of a major key each for keeping a key signature unchanged.

In the alternative, there may be provided, in addition to the same keynote keeping chord table storage means, a relative key chord sequence storage means which stores a set of chord sequences each indicative of a change from a major key to its relative minor key having the same key signature as that of the major key. If no chord corresponding to the new chord is found in the same keynote keeping chord table storage means, a keynote determining means may search the relative key chord sequence storage means for a pair of an old chord immediately preceding the new chord and the new chord to determine a keynote in the new chord time interval.

In addition to the chord progression providing means, the current keynote storage means, the same keynote keeping chord table storage means, the same keynote determining means and the tonality data producing means, each described above, another mode of the tonality determining apparatus of the invention further comprises: modulation chord sequence storage means for storing a set of chord sequences each indicative of a modulation from the current keynote to another keynote; modulation determining means operative when the same keynote keeping chord table storage means does not include a chord corresponding to the new chord for searching the modulation chord sequence storage means for a chord sequence corresponding to the pair of an immediately preceding old chord and the new chord to test a possible modulation to a different keynote; second tonality data producing means responsive to a modulation keynote signal from the modulation determining means, indicative of a modulation to the different keynote, for producing tonality data defining a set of pitch classes available in the time interval of the new chord; and keynote updating means responsive to the modulation keynote signal for updating the current keynote storage means to the different keynote.

This arrangement facilitates specifying a portion of the chord progression where the same keynote continues and locates an accurate point in the chord progression where a modulation takes place.

Each tonality determining apparatus described above may further comprise: chord-to-function table storage means for storing correspondence between chords and functions; direct converting means operative when the other keynote determining means (e.g., the same keynote determining means, modulation determining means) have failed to determine a keynote of the new chord for directly converting the new chord to a function by referencing the chord-to-function table storage means; keynote generating means for generating a keynote in accordance with the converted function; and means for producing tonality data defining a set of pitch classes available in the time interval of the new chord based on the generated keynote and the new chord.

This arrangement makes it possible to determine an available tonality in every chord time interval of the chord progression.

For preference, chord data stored in each of the same keynote keeping chord table storage means, the relative key chord sequence table storage means and the modulation chord sequence storage means (each of which constitutes a musical knowledge database or part thereof) takes the form of a function name (functional representation) having a function part indicative of a scale degree of a chord root from a keynote and a type part indicative of a chord type. This achieves saving of storage capacity. In addition, the keynote determining means may preferably include function generating means which converts a chord root in the chord progression to a scale degree (function) from a keynote and obtains a function name of the chord to enable searching of table storage means for that function name. This provides a high speed search.

In accordance with the invention each tonality determining apparatus of the invention described above can be applied to an automatic accompaniment performing apparatus to enable playing of an accompaniment with a desired tonality.

A mode of the automatic accompaniment performing apparatus of the invention comprises: chord progression providing means for providing a chord progression in which each chord is represented by a root and a type; database means for storing a database of musical knowledge for evaluating a function of a chord; analyzing means for analyzing the chord progression based on the database stored in the database means; tonality data producing means responsive to the analyzing means for producing tonality data defining a set of pitch classes available in a time interval of each chord in the chord progression; and accompaniment forming means for forming an accompaniment based on tonality data from the tonality data producing means.

In accordance with an aspect of the invention, there is provided an automatic accompaniment performing apparatus which comprises: chord progression providing means for providing a chord progression in which each chord is represented by a type and a root; function and keynote determining means for determining a function and keynote of each chord in the chord progression, and accompaniment forming means for forming an accompaniment in a time interval of the each chord in the chord progression based on the type, function and keynote of the each chord.

This arrangement enables playing of an accompaniment having a natural pitch line suitable for the combination of chord type, function and keynote in a music progression.

The function and keynote determining means may comprise: musical knowledge storage means for storing musical knowledge of correspondence between chord patterns in which each chord is represented by a root and a type, and function name patterns in which each chord is represented by a function and a type; and function and keynote extracting means for extracting the function and keynote of the each chord in the chord progression by referencing the musical knowledge storage means.

The accompaniment forming means may be implemented in several way.

In an embodiment, the accompaniment forming means comprises: accompaniment pattern storage means for storing accompaniment tone pitch data arranged to define an accompaniment pattern; pitch modifying table storage means for storing pitch modifying data for modifying accompaniment tone pitch data from the accompaniment pattern storage means; first pitch modifying means for modifying accompaniment tone pitch data from the accompaniment pattern storage means in the time interval of the each chord in the chord progression in accordance with pitch modifying data stored in the pitch modifying table storage means and corresponding to a combination of the function and type of the each chord, and the accompaniment tone pitch data to thereby produce first pitch data; and second pitch modifying means for modifying the first pitch data in accordance with the keynote in the time interval to thereby produce second pitch data indicative of a final accompaniment tone pitch.

In another embodiment, the accompaniment forming means comprises: a plurality of accompaniment pattern storage means each for storing an accompaniment pattern for a different one of combinations of a function and a type of a chord; accompaniment pattern selecting means for selecting one accompaniment pattern storage means from the plurality of accompaniment pattern storage means in accordance with a function and a type of a chord in the chord progression; and pitch modifying means for modifying pitch contents of an accompaniment pattern from the selected accompaniment pattern storage means in accordance with a keynote of the chord in the chord progression.

The interrelation among chord function, root and keynote is such that a pitch class having a chord function scale degree from a keynote defines a root. For example, for a function of II and keynote of C, a corresponding root is defined by D. Conversely, if a root is E and if a function is II, then a keynote is given by D. This interrelationship among function, root and keynote enables several modes of the automatic accompaniment performing apparatus in accordance with the invention.

A mode of the automatic accompaniment performing apparatus comprises: chord progression providing means for providing a chord progression in which each chord is represented by a type and a root; function determining means for determining a function of the each chord in the chord progression; and accompaniment forming means for forming an accompaniment in a time interval of the each chord in the chord progression in accordance with a combination of the function, root and type of the each chord.

Another mode of the automatic accompaniment apparatus comprises: chord progression providing means for providing a chord progression in which each chord is represented by a type and a root; function and keynote determining means for determining a function and keynote of the each chord in the chord progression; tonality determining means for determining a tonality in a time interval of the each chord in the chord progression based on the function and keynote from the function and keynote determining means and the type from the chord progression providing means; and accompaniment forming means for forming an accompaniment in the time interval of the each chord in the chord progression in accordance with the tonality from the tonality determining means.

Another aspect of the invention aims to provide an automatic accompaniment performing apparatus with a simplified accompaniment forming system design and implementation.

A mode of the automatic accompaniment performing apparatus comprises: chord progression providing means for providing a chord progression in which each chord is represented by a type and a root; function and keynote determining means for determining a function and keynote of each chord in the chord progression; and accompaniment forming means for forming an accompaniment in a time interval of each chord in the chord progression based on the type, function and keynote of each chord; and in which the accompaniment forming means comprises: accompaniment pattern generating means for generating a pattern of pitch interval data indicative of a pitch interval from a keynote in accordance with a type from the chord progression providing means and a function from the function and keynote determining means; and pitch generating means for combining keynote data indicative of a keynote from the function and keynote determining means and pitch interval data from the accompaniment pattern generating means to thereby generate a pitch of an accompaniment tone.

With this arrangement, all accompaniment patterns generated in the accompaniment pattern generating means can be written in a single common key. This facilitates implementation of the accompaniment pattern generating means.

In another mode, the automatic accompaniment performing apparatus comprises: chord progression providing means for providing a chord progression in which each chord is represented by a type and a root; function and keynote determining means for determining a function and keynote of the each chord in the chord progression; group defining means for defining a first chord group and a second chord group; first accompaniment forming means for forming an accompaniment in a time interval of a first chord in the chord progression which pertains to the first chord group by using results from the function and keynote determining means; and second accompaniment forming means for forming an accompaniment in a time interval of a second chord in the chord progression which pertains to the second chord group without using the results from the function and keynote determining means.

With this arrangement, the second accompaniment forming means may be realized by a simple structure since accompaniment patterns generated in the second accompaniment forming means can be made independent of a key.

The first accompaniment forming means may comprise: first accompaniment pattern generating means for generating a pattern of pitch interval data indicative of a pitch interval from a keynote in accordance with a type of the first chord from the chord progression providing means and a function of the first chord from the function and keynote determining means; and first pitch generating means for combining keynote data indicative of a keynote from the function and keynote determining means and pitch interval data from the first accompaniment pattern generating means to thereby generate a pitch of an accompaniment tone.

In the alternative, the first accompaniment forming means may comprise: first accompaniment pattern generating means for generating a pattern of pitch interval data indicative of a pitch interval from a root in accordance with a type of the first chord from the chord progression providing means and a function of the first chord from the function and keynote determining means; and first pitch generating means for combining root data indicative of a root of the first chord from the chord progression providing means and pitch interval data from the first accompaniment pattern generating means to thereby generate a pitch of an accompaniment tone.

The second accompaniment forming means may comprise: second accompaniment pattern generating means for generating a pattern of pitch interval data indicative of a pitch interval from a root in accordance with a type of the second chord from the chord progression providing means; and second pitch generating means for combining root data indicative of a root of the second chord from the chord progression providing means and pitch interval data from the second accompaniment pattern generating means to thereby generate a pitch of an accompaniment tone.

BRIEF DESCRIPTION OF THE DRAWINGS

The invention will now be described in more detail, by way of example, with reference to the following description taken in conjunction with the accompanying drawings in which:

FIG. 5 shows a chord member table residing in ROM in FIG. 2;

FIG. 6 illustrates a table of chord type identification data;

FIGS. 7A and 7B show a list of variables used in the specific embodiment;

FIG. 11 illustrates a same keynote keeping chord table residing in ROM in FIG. 2;

FIG. 13 illustrates a relative key (major-to-relative-minor modulation) chord sequence table residing in ROM in FIG. 2;

FIG. 15 illustrates a pivot chord table residing in ROM in FIG. 2;

FIG. 16 illustrates a post-modulation chord table residing in ROM in FIG. 2;

FIG. 19 illustrates a chord-to-function table residing in ROM in FIG. 2;

FIG. 21 illustrates a scale table residing in ROM in FIG. 2;

FIG. 23 illustrates part of a scale member table;

FIG. 24 shows a table of scale identification data;

FIG. 27 illustrates an accompaniment pattern memory storing the accompaniment pattern in FIG. 26;

FIG. 28 illustrates a pitch modifying table for modifying pitch contents of an accompaniment pattern such as the one in FIG. 26;

FIG. 33 illustrates a modification of the same keynote keeping chord table;

FIG. 37 illustrates a pitch modifying table usable in the first modification of the automatic accompaniment performing apparatus;

FIG. 41 illustrates a pitch modifying table usable in the second modification of the automatic accompaniment performing apparatus;

FIG. 45 illustrates a pitch modifying table usable in the third modification of the automatic accompaniment performing apparatus;

DETAILED DESCRIPTION OF THE PREFERRED EMBODIMENTS

Figure 1A:
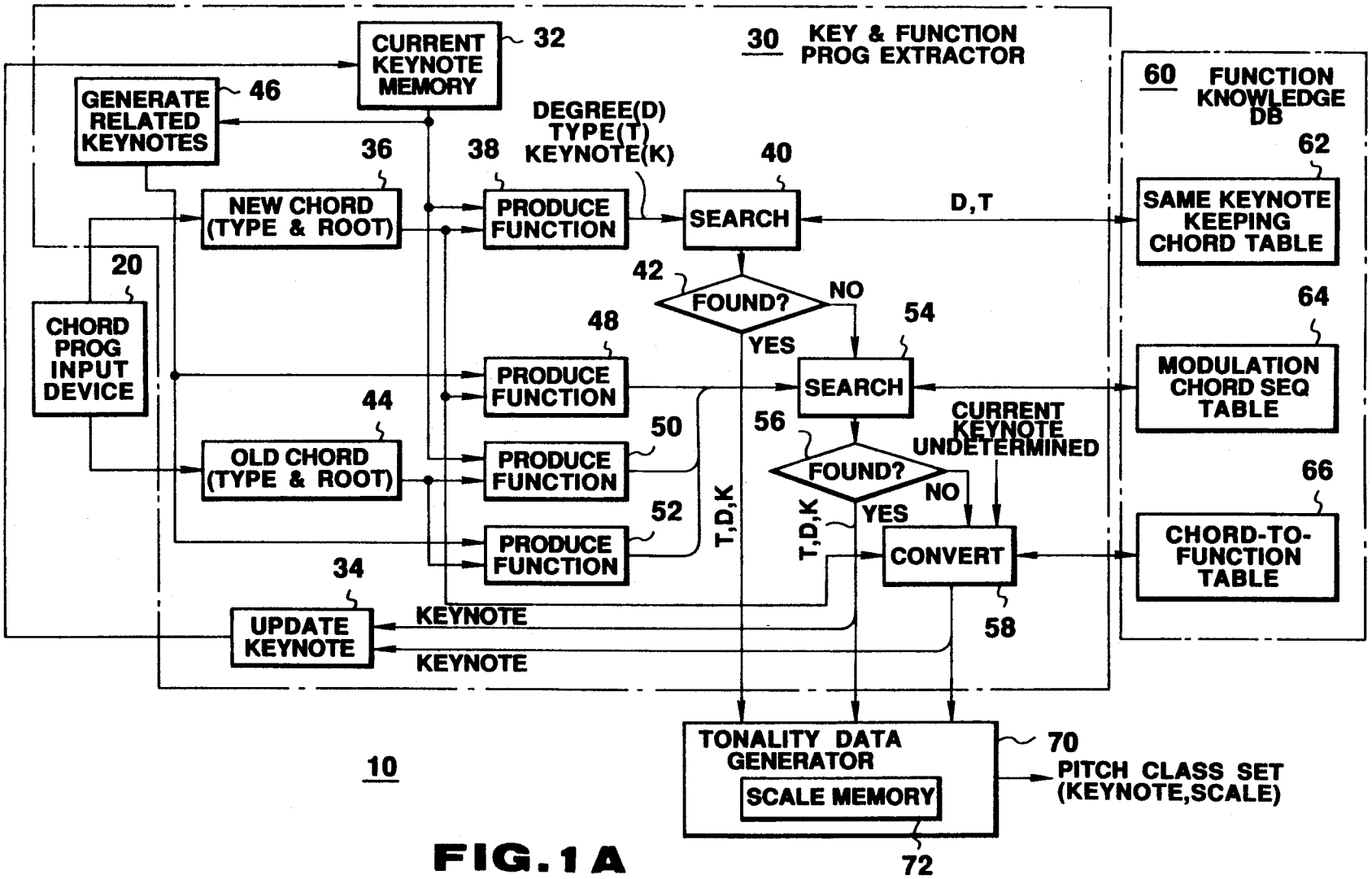
FIG. 1A is a functional block diagram of a tonality determining apparatus in accordance with an embodiment of the invention.

Several embodiments of the automatic accompaniment performing apparatus of the invention are shown in FIGS. 1A–1E. The present automatic accompaniment apparatus basically comprises a tonality determining apparatus and an accompaniment forming apparatus. FIG. 1A shows an embodiment of the tonality determining apparatus, designated 10, in a functional block diagram. FIGS. 1B–1E show functional block diagrams of several embodiments of the accompaniment forming apparatus, designated 90, 90M, 90N and 190, respectively.

The purpose of the tonality determining apparatus 10 is to produce, from a progression of chords each represented by a root and type, tonality data defining a pitch class set available in respective chord time intervals of the chord progression.

The tonality determining apparatus 10 basically comprises four components, i.e., chord progression input device 20, key and function progression evaluator 30, function knowledge database 60 and tonality data generator 70. The chord progression input device 20 provides a chord progression in which each chord is represented by a root and a type. The key and function progression extractor 30 extracts, from a chord progression from the chord progression input device, a keynote and function of each chord in the chord progression based on musical knowledge stored in the function knowledge database 60 to thereby produce a progression of keynotes and functions suitable for the chord progression. The tonality data generator 10 produces tonality data defining a pitch class set available in respective chord intervals of the chord progression in response to the progression of keynotes and functions from the key and function progression extractor 30.

The function knowledge database 60 of FIG. 1A comprises a same keynote keeping chord table memory 62 which stores a set of chords each for keeping keynote unchanged, a modulation chord sequence table memory 64 which stores a set of chord sequences each indicative of a modulation (change of key), and a chord-to-function table memory 66 which stores correspondence between chords and functions. To save storage capacity, each table 62, 64, 66 is preferably designed to store a chord which takes the form of functional representation data indicative of a scale degree of a chord root from a keynote and indicative of a chord type.

The key and function progression extractor 30 includes a current keynote memory 32. The current keynote memory 32 stores keynote data indicative of a current keynote i.e., the one that has been determined for an immediately preceding chord (old chord) from the chord progression input device 20. The contents of the current keynote memory 32 is updated by a keynote updating module 34 when a keynote for a new chord immediately succeeding the old chord is found to be different from the keynote of the old chord.

The key and function progression extractor 30 has a capability of determining whether a new chord from the chord progression input device 20 functions to maintain the current keynote in the current keynote memory 32. To this end the key and function progression extractor 30 includes a function producing module 38 and a search module 40. The function producing module 38 receives a current keynote from the current keynote memory 32 and a new chord from new chord register 36 coupled to the chord progression input device 20, and generates a function of the new chord specified (evaluated) by the current keynote by computing a scale degree indicative of the pitch difference between the current keynote and the new chord root. The function of the new chord evaluated by the current keynote is supplied to the search module 40. Then the search module 40 searches the same keynote keeping chord table 62 for the new chord. If the same keynote keeping chord table 62 includes a chord having the type of the new chord and the function of the new chord evaluated by the current keynote (42), this verifies the new chord function generated by the function producing module 38 which function has been generated on the assumption that the keynote of the new chord is identical with the current keynote, thus indicating that the current keynote maintains in the new chord time interval. Then, the verified function and keynote of the new chord as well as the type is passed to the tonality data generator 70 which produces tonality data defining a pitch class set available in the new chord time interval.

The key and function progression extractor 30 further comprises a modulation determining means operative when the same keynote keeping chord table 62 does not include a chord entry corresponding to the new chord for examining a possible modulation. In FIG. 1A, the modulation determining means is realized by a related keynote generating module 46, three function generating modules 48, 50, and 52, and a search module 54. Preferably, the related keynote generating module 46 generates a plurality of keys related to the current keynote in the current keynote memory 32. The function generating module 48 receives the related keynotes and the new chord to generate functions of the new chord evaluated by the respective related keynotes. The function generating module 50 receives the current keynote from the current keynote memory 32 and an old chord (immediately preceding the new chord) from an old chord register 44 coupled to the chord progression input device 20, and generates a function of the old chord evaluated by the current keynote. The function generating module 52 receives the related keynotes and the old chord, and generates functions of the old chord evaluated by the respective related keynotes. The functions generated in the function generating modules 48, 50 and 52 are supplied to the search module 51 together with data of the new chord type, old chord type, current keynote and related keynotes. Then the search module 54 searches the modulation chord sequence table 64 for the supplied data set comprising the old chord type, old chord function specified by the current keynote, old chord functions evaluated by the related keynotes, new chord type, and new chord functions evaluated by the related keynotes. If the modulation chord sequence table includes a chord sequence entry matching the supplied data set with respect to a related keynote (56), then the chord pair or sequence of the old and new chords does indicate a modulation from the current keynote to that related keynote, and the new chord function evaluated by that related keynote is verified. In this case, the related keynote, new chord type and the verified new chord function specified by the related keynote are supplied to the tonality data generator 70 which then produces tonality data defining a pitch class set available in the new chord time interval. In addition, the related keynote is supplied to the keynote updating module 34 which then updates the current keynote memory 32 to the related keynote.

The key and function progression entractor 30 further comprises a direct conversion means operative when the current keynote has not yet been determined because the new chord is the first chord in the chord progression, or when the modulation chord sequence table 64 does not include a chord sequence entry corresponding to the sequence of the old and new chords for directing evaluating a function of the new chord. In FIG. 1A, the direct conversion means is shown by a converting module 58. The converting module receives data of the new chord type and root from the new chord buffer 36, and references (looks up) the chord-to-function table 66 to obtain function data of the new chord. Further, the converting module computes a keynote from the new chord root and function. The keynote, new chord type and new chord function from the converting module are supplied to the tonality generating module 70 which then produces tonality data representative of a pitch class set available in the new chord time interval. The keynote generated by the converting module is also supplied to the keynote updating module 34 by which the current keynote memory 32 is updated to that keynote.

Preferably the tonality data generator 70 may comprise a scale memory 72 which converts a supplied chord function (scale degree of root from keynote) and type to a scale suitable for the chord specified by the supplied function and type. The combination of the scale and the supplied keynote defines a pitch class set available in the new chord time interval. Each pitch class in the set may be obtained by transposing a corresponding note in the scale in accordance with the keynote.

In this manner, the key and function progression extractor 30 in cooperation with the function knowledge database 60 evaluates a function and keynote of each chord in the chord progression with each chord represented by a type and a root. In accordance with results from the key and function progression extractor 30, the tonality data generator 70 produces tonality data of a desired pitch class set in the individual chord time intervals of the chord progression.

Accompaniment forming apparatus 90, 90M, 90N and 190 shown in FIGS. 1B–1E, respectively, form an accompaniment based on the results from a tonality determining apparatus such as the one shown in FIG. 1A.

Figure 1B:
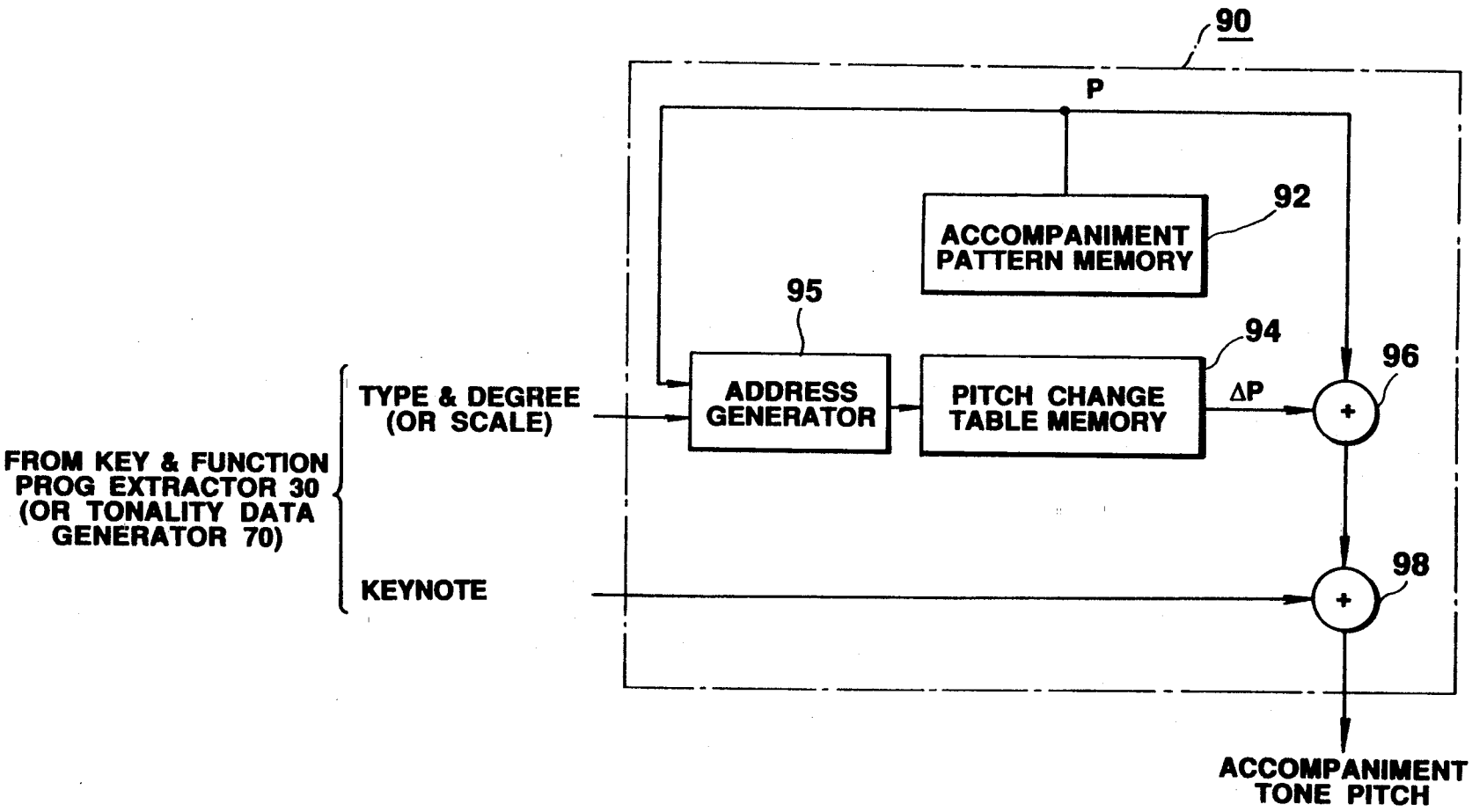
FIGS. 1B to 1E are functional block diagrams of several embodiments of an accompaniment forming section of an automatic accompaniment performing apparatus in accordance with the invention.

The accompaniment forming apparatus 90 of FIG. 1B comprises an accompaniment pattern memory 92. The accompaniment pattern memory 92 stores an accompaniment pattern, pitch contents of which are written in a reference keynote (e.g., keynote C) and are suitable for a reference chord function name (e.g., I major) having a reference function and a reference type. The stored accompaniment pattern is repeatedly read out by a conventional reading means (not shown). In FIG. 1B, a reference accompaniment tone pitch read out from the accompaniment pattern memory is designated by a letter P.

The accompaniment forming apparatus 90 further comprises a pitch change table memory 94. Each table element in the pitch change table 94 stores pitch difference data ΔP for modifying the pitch data P from the accompaniment pattern memory 92. A combination of a chord type, a chord function (scale degree) and a pitch data item P serves to specify a table element in the pitch change table memory 94. In the alternative, a combination of a scale and a pitch data item P may be used to specify (address) an element in the pitch change table 94. To this end, data of a chord type and function (scale degree) from the key and function progression extractor 30 (or data of a scale from the tonality data generator 70) and pitch data P from the accompaniment pattern memory 92 are supplied to an address generator 95 which generates an address specifying a table element in the pitch change table memory 94. The pitch difference ΔP stored in this table element is read out and added by an adder 96 (first pitch modifying means) to the reference pitch P from the accompaniment pattern memory 92. The modified pitch data from the adder 96 indicates a pitch suitable for an extracted chord function and type, or scale. The adder 96 output is further combined by a second adder 98 (second pitch modifying means) with a keynote from the tonality data generator 70. The adder 98 output indicates an actual accompaniment tone pitch suitable for the combination of the keynote, chord function and chord root from the tonality determining apparatus 10. The actual pitch data is then supplied to a tone generator (not shown) which produces an accompaniment tone signal having the actual pitch.

Figure 1C:
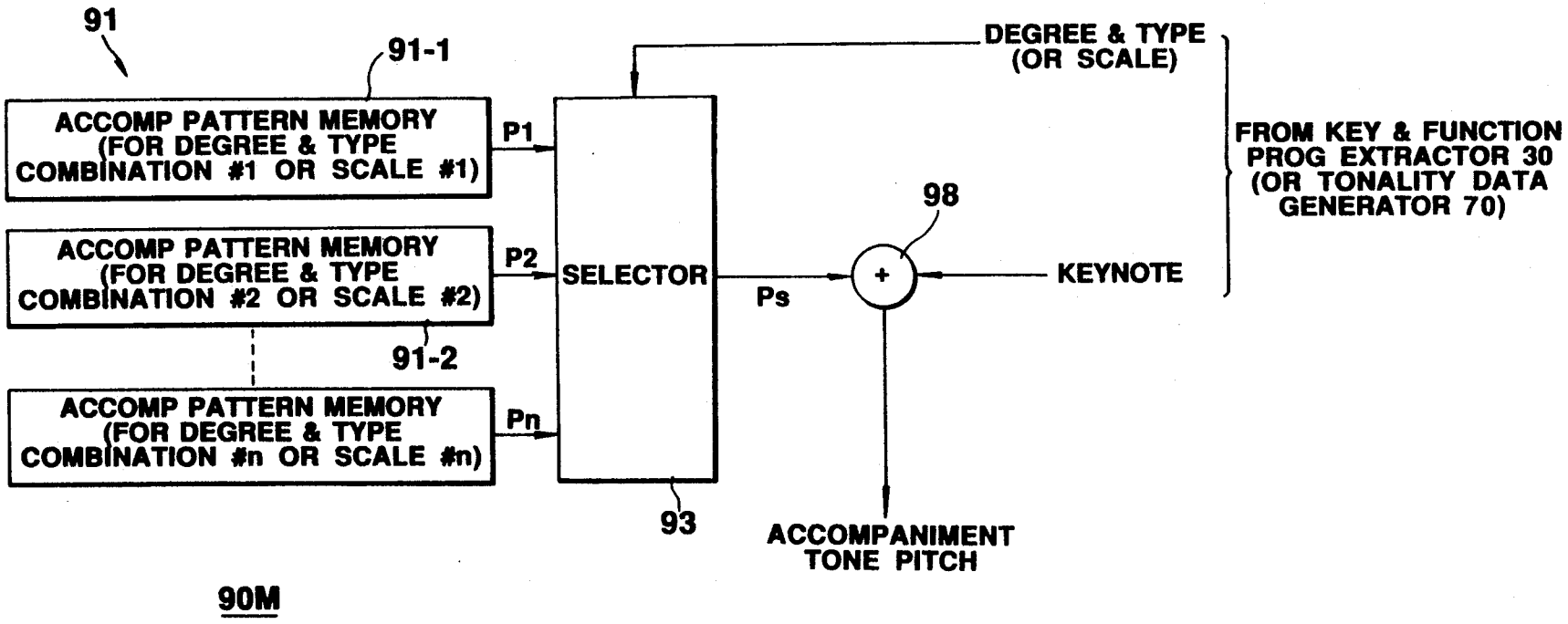

FIG. 1C depicts a second mode of the accompaniment forming apparatus, designated 90M. This apparatus 90M comprises a plurality of accompaniment pattern memories individually designated by 91-1 to 91-n and generally designated 91, each provided for a different one of the chord function (scale degree) and type combinations (or scales). Each accompaniment pattern memory stores an accompaniment pattern written in a reference keynote (e.g., keynote C) and having a pitch line suitable for a particular function and type combination, or scale. For example, the first accompaniment pattern memory 91-1 stores an accompaniment pattern suitable for the combination of chord function of I and chord type of major, or the ionian scale.

The accompaniment forming apparatus 90M further comprises a selector 93. The selector 93 selects one accompaniment pattern memory from the plurality of accompaniment pattern memories 91-1 to 91-n in accordance with a chord function and type (or scale) from the tonality determining apparatus 10. A reference symbol Ps denotes a pitch selected by the selector 93 from among the pitches P1 to Pn from the plurality of accompaniment pattern memories 91-1 to 91-n. The selected pitch data Ps is combined by an adder 98 (pitch modulating means) with keynote data from the tonality determining apparatus 10. The adder 98 output indicates an actual (final) accompaniment tone pitch.

With the arrangement 90M of FIG. 1C, rhythm components of the plurality of accompaniment patterns stored in the pattern memories 91-1 to 91-n can be made independent from one another. Thus, the accompaniment forming apparatus 90M can form an accompaniment having a rhythm (tone durational sequence) depending on an associated scale (or chord function and type combination) from the tonality determining apparatus 10. That is, the accompaniment rhythm varies as the chord progression moves from one chord to another.

Figure 1D:
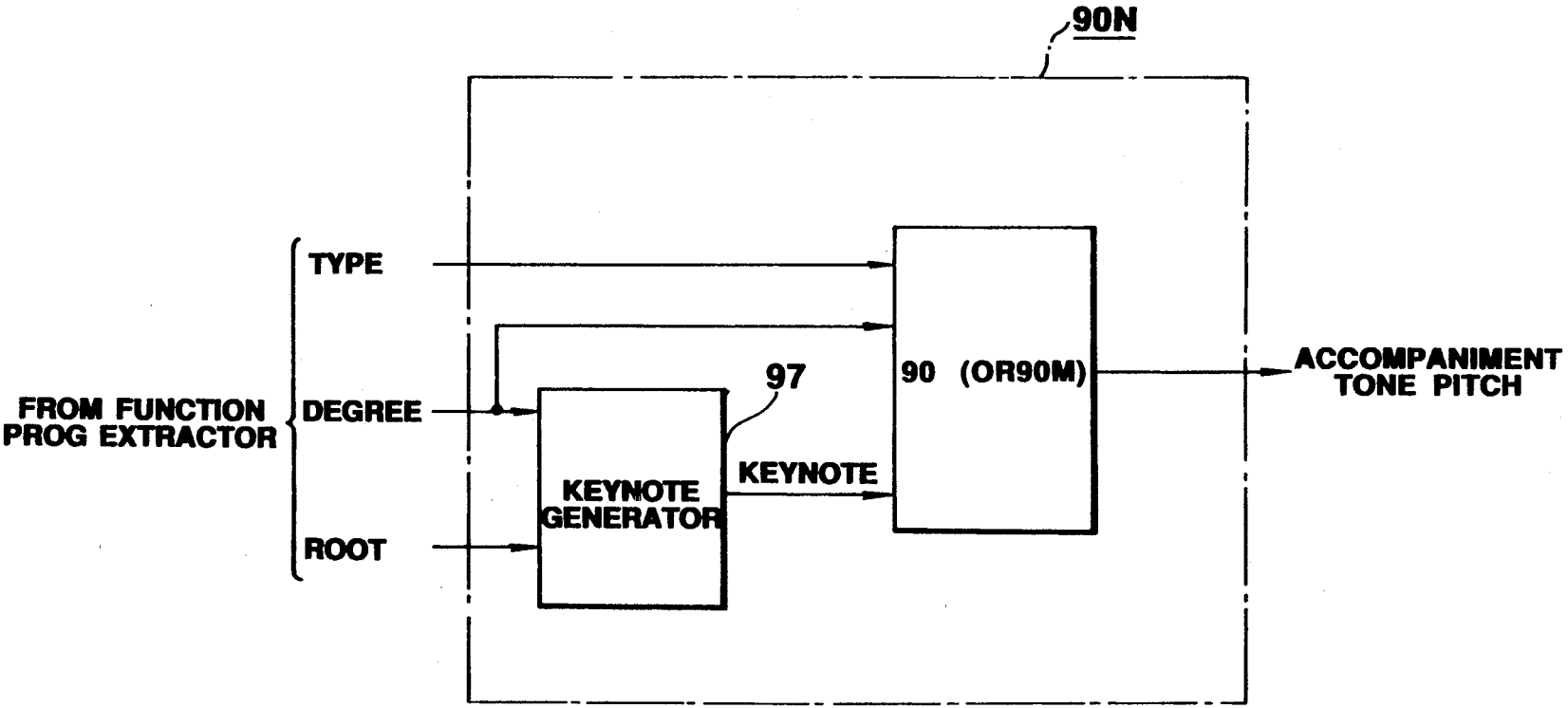

FIG. 1D depicts a third mode of the accompaniment forming apparatus, designated 90N. This accompaniment forming apparatus 90N receives a chord type, root and function from a function progression extractor which may be realized by the key and function progression extractor 30 in FIG. 1A or part thereof. Specifically data of function (scale degree) and root is supplied to a keynote generator 97 which generates data of a keynote. Since a chord function defines a scale degree of a chord root from a keynote, the keynote is obtained by computing a pitch class that is lower than the root pitch class by the scale degree defined by the chord function. For example, if the function is II and the root is D, then the corresponding keynote is C. The keynote data from the keynote generator 97 and the chord type and function data from the function progression extractor are supplied to either the accompaniment forming apparatus 90 in FIG. 1B or the accompaniment forming apparatus in FIG. 1C which then produce accompaniment tone pitch data suitable for the supplied information in the manner as described.

Elements 92, 94, 95 and 96 in FIG. 1B define an accompaniment pattern generator means which generates a pattern of pitch interval data items each indicative of a pitch interval from a keynote in accordance with the combination of chord type and function. In the arrangement of FIG. 1C, a similar function is achieved by components 91 and 93. It should be understood that each accompaniment forming apparatus 90, 90M, 90N in FIGS. 1B-1D uses results from the key and function progression extractor such as the one 30 in FIG. 1A with respect to all chords.

Figure 1E:
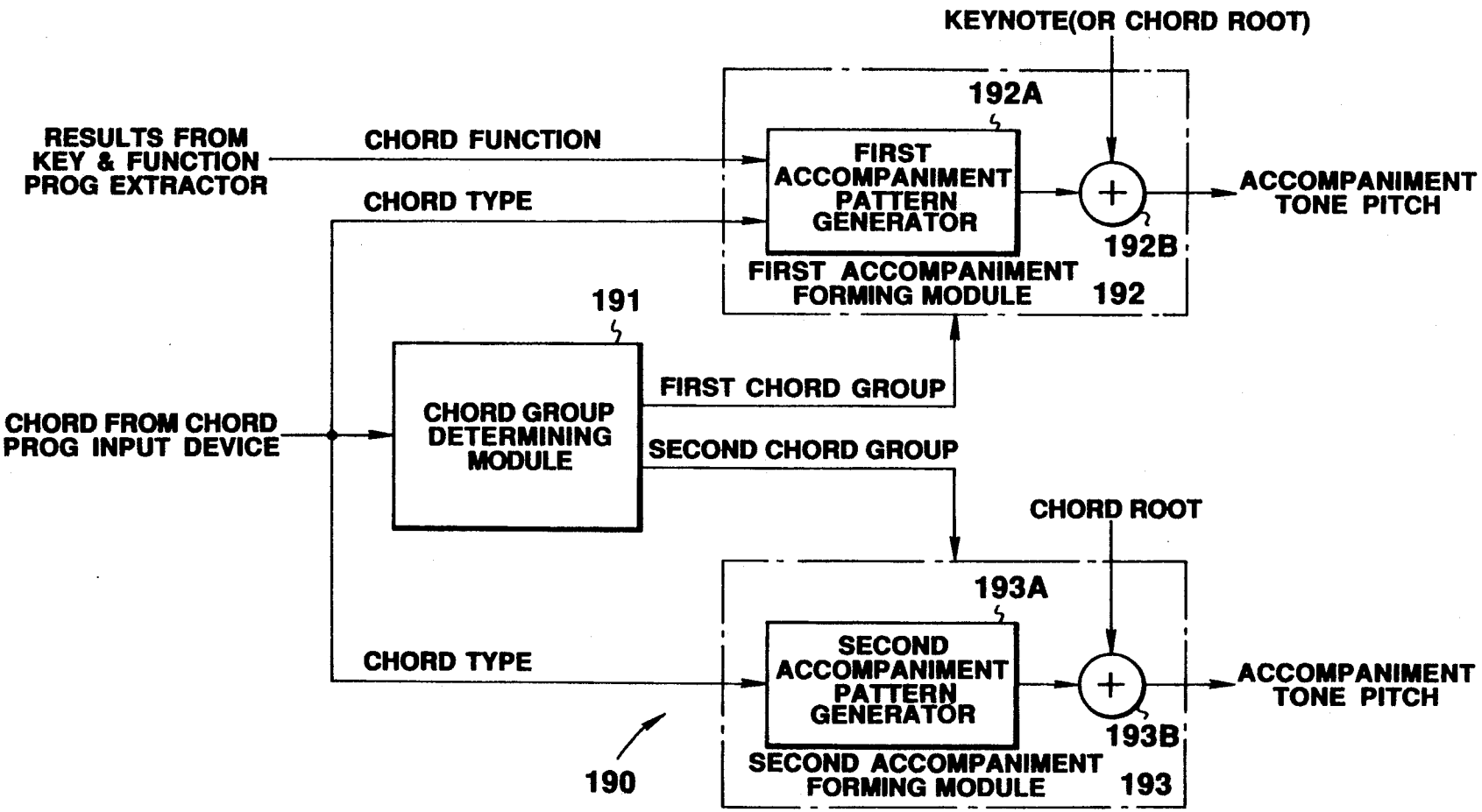

FIG. 1E depicts another accompaniment forming apparatus, designated 190. This apparatus 190 forms an accompaniment in different ways according to chord groups. To this end, there is provided a chord group determining module 191. The chord group determining module 191 receives a chord from the chord progression input device and classifies the chord into a first or second chord group. If the chord pertains to the first chord group (key relevant chord group), a first accompaniment forming module 192 is put into operation to form an accompaniment in the time interval of the first group chord by using results from the key and function progression extractor. If the chord pertains to the second chord group (key independent chord group), then a second accompaniment forming module 193 is put into operation and forms an accompaniment in the time interval of the second group chord without using results from the key and function progression extractor 30.

The first accompaniment forming module 192 comprises a first accompaniment pattern generator 192A which receives the type of the first group chord from the chord progression input device and the function of the first group chord and generates a corresponding accompaniment pattern. The generated accompaniment pattern contains pitch interval data indicative of a pitch interval from either a keynote or chord root. An adder 192B adds the pitch interval data to either keynote data indicative of a keynote from the key and function progression extractor (if the pitch interval data indicates a pitch interval from a keynote) or chord root data indicative of the root of the first group chord (if the pitch interval data indicates a pitch interval from a root) to thereby generate a pitch of an accompaniment tone.

The second accompaniment forming module 193 comprises a second accompaniment pattern generator 193A which receives the type of the second group chord from the chord progression input device and generates a corresponding accompaniment pattern. The accompaniment pattern generated by the second accompaniment pattern generator 193A contains pitch interval data indicative of a pitch interval from a chord root. An adder 193B combines the pitch interval data with root data of the second group chord from the chord progression input device. The adder 193B output indicates an actual accompaniment tone pitch.

The arrangement of FIG. 1E has an advantage of minimizing the size of the accompaniment pattern set provided in the second pattern generator 193.

Figure 2:
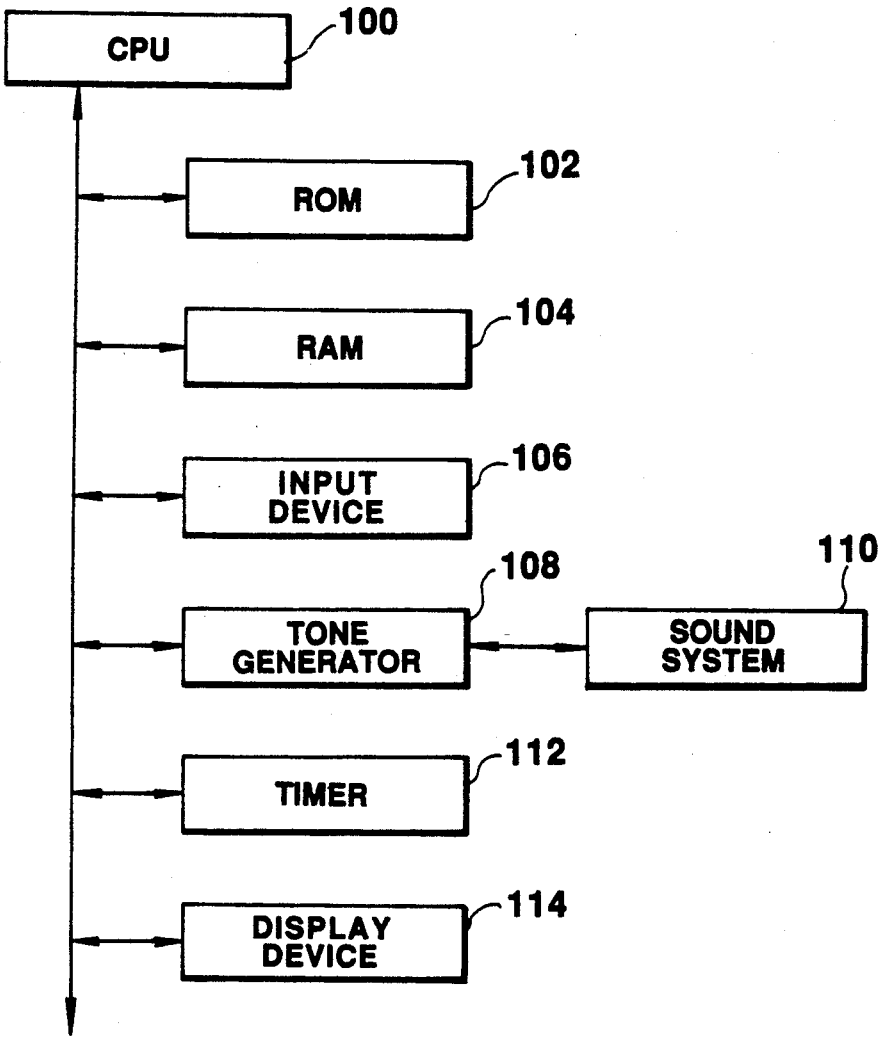
FIG. 2 is a block diagram of a hardware organization of an automatic accompaniment performing apparatus in accordance with a specific embodiment of the invention.
Figure 3:
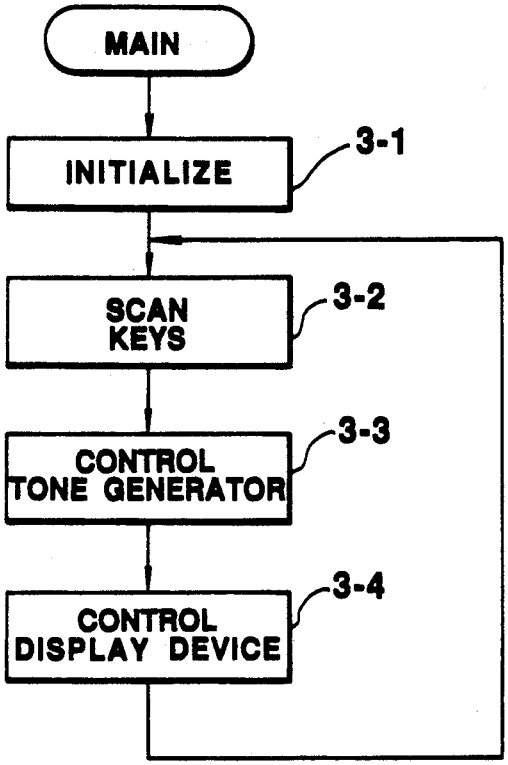
FIG. 3 is a flow chart of a main program executed by CPU in FIG. 2.

FIG. 2 shows a hardware block diagram of an automatic accompaniment performing apparatus in accordance with a specific embodiment of the invention. CPU100 controls the entire system of the accompaniment apparatus. ROM102 stores programs to be executed by CPU100 and also stores permanent data including a musical function knowledge database. RAM104 serves as a working memory under the control of CPU100. An input device 106 includes a musical keyboard for inputting melodies and chords. A tone generator 108 synthersizes a tone signal under the control of CPU100. A sound system 110 receives the tone signal to reproduce and emit a corresponding sound. A timer 112 measures an elapse of a predetermined time to periodically generate a timer interrupt request signal by which a timer interrupt routine (FIG. 4) is activated. A display device 114 displays data and messages such as chord progression, function progression, keynote progression and tonality (available pitch class set) progression.

Figure 4:
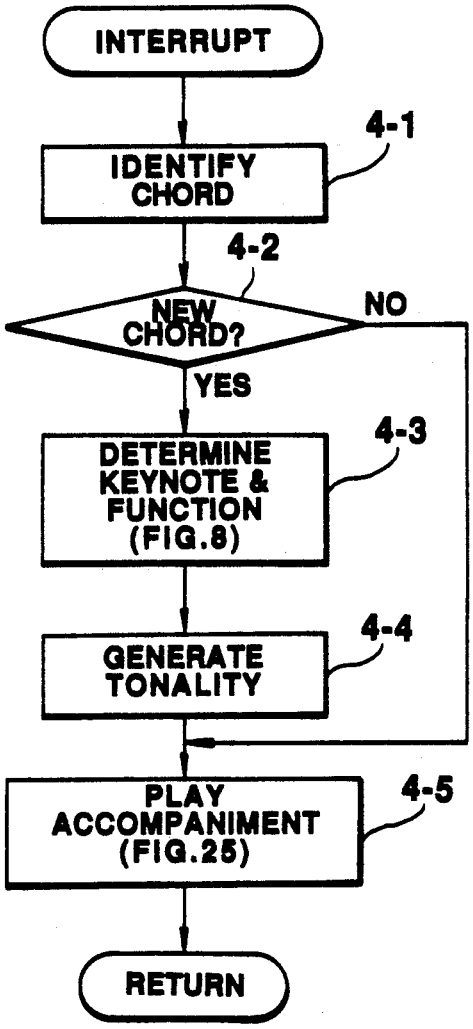
FIG. 4 is a flow chart of a time interrupt routine executed by CPU in FIG. 2.

FIG. 4 is a flow chart of the main program executed by CPU100. Upon power-on, CPU100 initializes the tonality determining system (3-1). The initialization process 3-1 comprises initializing variables in FIGS. 7A and 7B to predetermined values. At 3-2, CPU100 scans the input device 106 in a conventional manner. At 3-3, CPU100 controls the tone generator 106 based on melody key data entered from a melody section of the musical keyboard to produce a melody tone. At 3-4, CPU100 controls the display device 3-4 to display analized results of an input chord progression (e.g., a progression of available pitch classes). For example, the display device 3-4 displays a currently available pitch class set in a "navigator" fashion by turning on display elements (e.g., LED lamps) disposed in correspondence to musical keys of those pitch classes in the keyboard. This will facilitate a performer's improvization.

FIG. 4 shows a timer interrupt routine regularly executed by CPU100 each time the timer 112 has been timed out. At 4-1, CPU100 examines accompaniment key data (sampled by the scan keys routine 4-2) to identify a type and root of a new chord designated from the keyboard in a conventional manner. When a new chord has been detected (4-2), CPU100 determines a function and keynote of that new chord (4-3). Then, CPU100 produces tonality data defining a pitch class set available in the time interval of the new chord (4-4). Finally, CPU100 plays an accompaniment by forming accompaniment data in accordance with the tonality data and controlling the tone generator 108 to produce an accompaniment tone (4-5).

FIG. 5 partly illustrates a chord member table CKT residing in ROM102. The chord member table CKT stores a set of chord members for each chord type. A chord root is represented by member data of "0". A chord member other than a chord root is represented by its pitch interval from the chord root. "1" indicates a pitch interval of half tone (minor second), "2" indicates a whole tone (major second) and so on until "11" indicates a pitch interval of major seventh. Data of "15" indicates a dummy and is used for a trial chord having three members because the table CKT uniformly assigns four memory locations to every chord. The chord member table CKT is referenced by the determine chord routine 4-1 to identify a type of a chord designated from the keyboard.

FIG. 6 illustrates a table of chord type identification data. For example "0" indicates a "major" type. Chord type identification data multiplied by four specifies a location in the chord member table CKT where the first member of that chord type is stored.

Figure 7A:
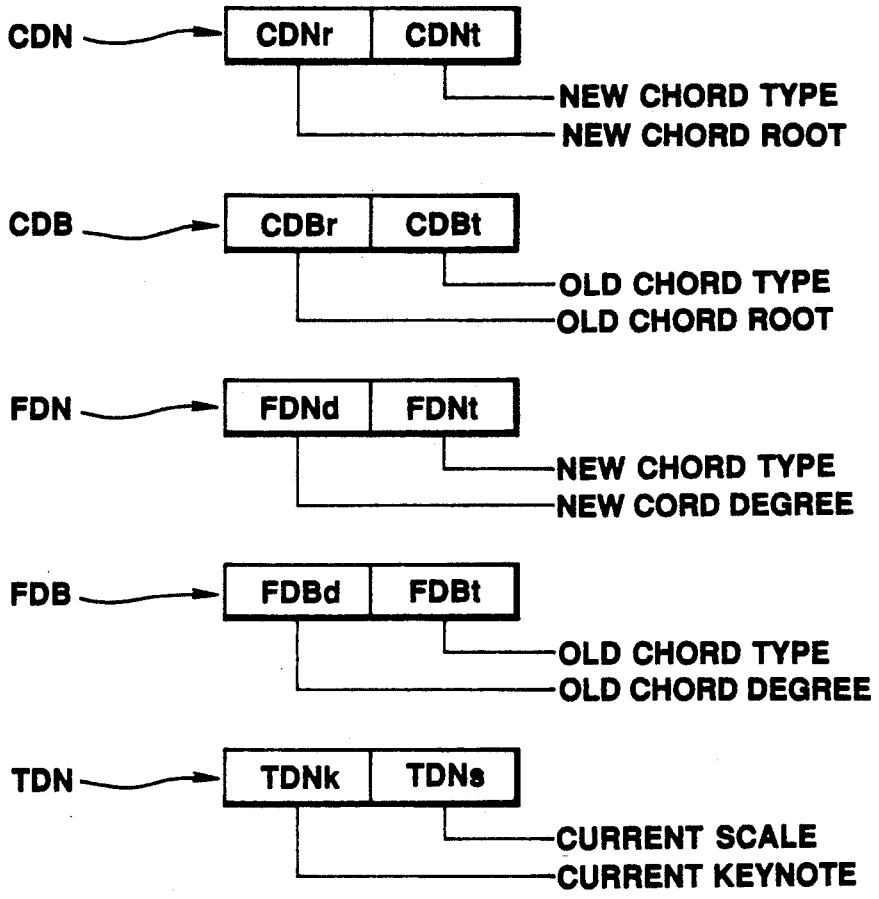

FIGS. 7A and 7B depict variables placed in RAM104. A variable (register) CDN indicates a new chord obtained in the determine chord routine 4-1. CDN comprises a root part $CDN_r$ indicative of a new chord root (pitch class), and a type part $CDN_t$ indicative of a new chord type. For example, a new chord of C major is represented by $CDN_r=0$, and $CDN_t=0$. Variable (register) CDB indicates an old chord immediately preceding the new chord in CDN. CDB comprises a root part $CDB_r$ indicative of an old chord root, and a type part $CDB_t$ indicative of an old chord type. Variable (register) FDN stores a function name (functional representation) of the new chord. FDN comprises a function or degree part $FDN_d$ indicative of a new chord function (scale degree) specified by a current keynote, and a type part $FDN_t$ indicative of the new chord type (same as $CDN_t$). For example, a function name of II major is represented by $FDN_d=2$, and $FDN_t=0$. Variable (register) FDB indicates a function name of the old chord. FDB comprises a function (degree) part $FDB_d$ indicative of an old chord function specified by the current keynote, and a type part $FDB_t$ indicative of the old chord type (same as $CDB_t$). Variable (register) TDN indicates a current tonality. TDN comprises a keynote part $TDN_k$ indicative of the current keynote, and a scale part $TDN_s$ indicative of a current scale. The combination of $TDN_k$ and $TDN_s$ defines a currently available pitch class set. For example, a tonality of C ionian having a pitch class set of C, D, E, F, G, A and B is represented by $TDN_k=0$, and $TDN_s=0$. $TDN_k=15$ indicates an undetermined current keynote before the first chord in a chord progression is supplied. $TDN_k$ is initialized to 15 in the initialize routine 3-1. Variable (table) TDK stores a plurality of, here, four related tonalities to the current tonality. Each tonality data TDK[i] in the table TDK comprises a keynote part $TDK_k[i]$ indicative of a keynote, and a scale part $TDK_s[i]$ indicative of a scale. The keynote part of the first tonality data TDK[0] stored at the first address of table TDK represents a dominant keynote to the current keynote. Similarly, keynote parts of TDK[1] , TDK[2] and TDK[3] store a subdominant keynote, a dominant of dominant keynote, and a subdominant of subdominant keynote, respectively, in relation to the current keynote. Variable (table) FDK stores function names of the old and new chords, evaluated by the respective related keynotes $TDK_k$. Each function name FDK[i] comprises a function (degree) part $FDK_d[i]$ indicative of a chord scale degree, and a type part $FDK_t[i]$ indicative of a chord type. Even addresses of the table FDK store new chord function names evaluated by the respective related keynotes while odd addresses store old chord function names evaluated by the related keynotes. Specifically, data FDK[0] stored at address 0 of the table FDK comprises a new chord scale degree evaluated by the dominant keynote to the current keynote, and the new chord type. Data FDK[1] at address 1 indicates an old chord function name in the dominant key. Similarly, FDK[2] and FDK[3] respectively indicate a new chord function name and an old chord function name, each evaluated by the subdominant key. FDK[4] and FDK[5] respectively indicate a new chord function name and an old chord function name, each evaluated by the dominant of dominant keynote. FDK[6] and FDK[7] respectively indicates a new chord function name and an old chord function name, each evaluated by the subdominant of subdominant keynote. Address i in the related tonality table TDK, which specifies a related key, corresponds to FDK table's addresses $2i$ (for the new chord) and $2i+1$ (for the old chord). Variable i is used as a pointer to an element in various tables.

Figure 8:
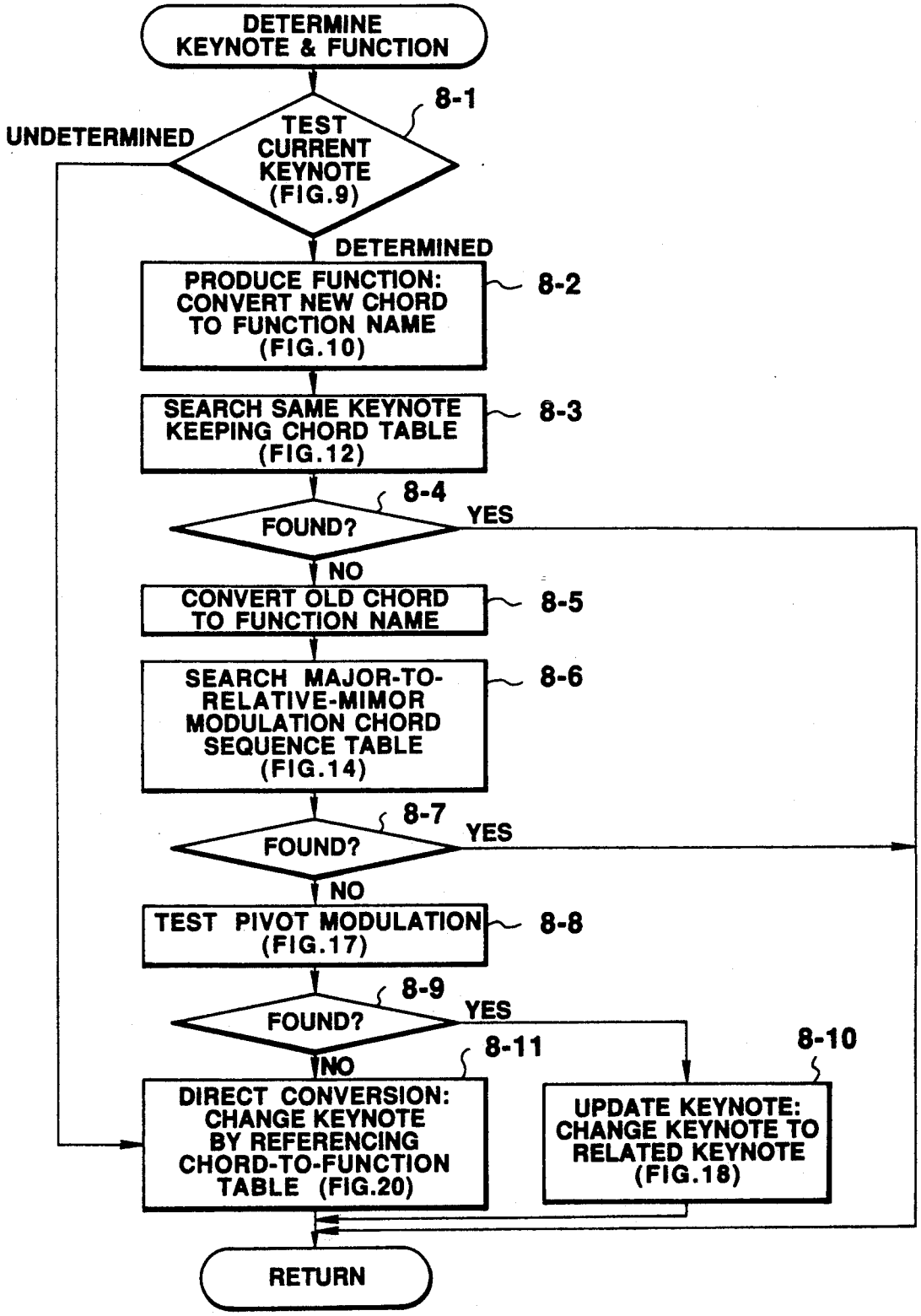
FIG. 8 is a flow chart of a routine of determine keynote and function.
Figure 9:
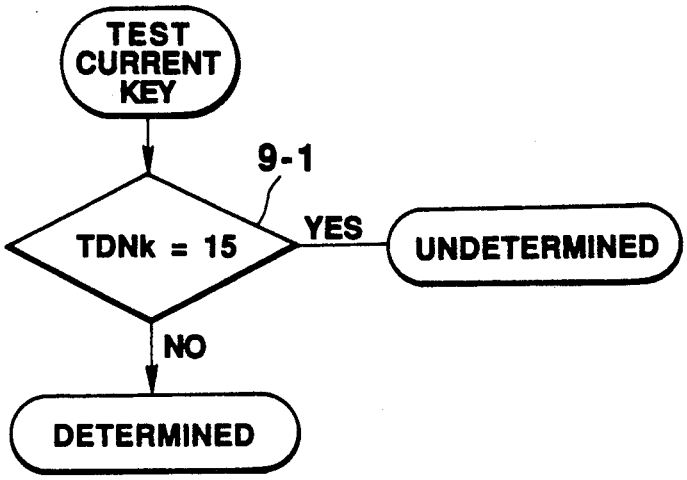
FIG. 9 is a flow chart of a routine of test current key.
Figure 10:
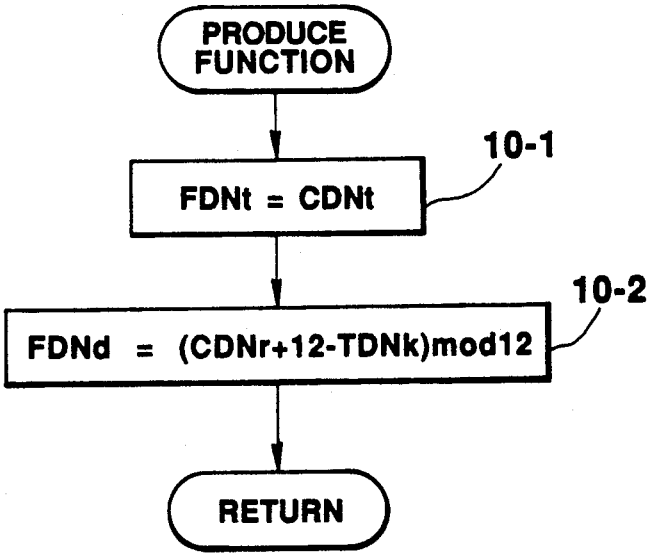
FIG. 10 is a flow chart of a routine of produce function.

FIG. 8 shows details of the determine keynote and function routine 4-4 (FIG. 4). At step 8-1, CPU100 tests the current keynote to see whether it has been determined. The details of the step 8-1 is shown in FIG. 9. As indicated at 9-1 in FIG. 9, if $TDN_k=15$, the current keynote has not yet been determined. If $TDN_k$ has a value other than 15, the current keynote has been determined and represented by the $TDN_k$ value. In this case, CPU100 converts the new chord to a function name evaluated by the current keynote at step 8-2 details of which are shown in FIG. 10. As described in FIG. 10, the new chord type $CDN_t$ is copied into $FDN_t$(10-1), and the new chord root (pitch class) $CDN_r$ is converted into a scale degree $FDN_d$ from the current keynote $TDN_k$(10-2).

In the next routine of 8-3 and 8-4, CPU100 searches a same keynote keeping chord table for the new chord function name (functional representation) FDN. The same keynote keeping chord table resides in ROM102. An example of the same keynote keeping table is illustrated in FIG. 11, designated by OFT. The table OFT stores a set of chords each keeping the current keynote unchanged. Each chord entry in the table OFT takes the form of a function name having a first part indicative of a function (scale degree), and a second part indicative of a chord type. For example, the entry data (0, 1) at address 1 in the same keynote keeping chord table OFT represents a chord function name of I6. The last address, here 28, of the table OFT stores data "15" indicative of end of the table.

If table OFT includes a chord entry identical with the new chord function name FDN, this verifies the assumptions made in the step 8-2 that the keynote for the new chord is the same as the current keynote, and that the new chord has a function of keeping the current keynote.

Figure 12:
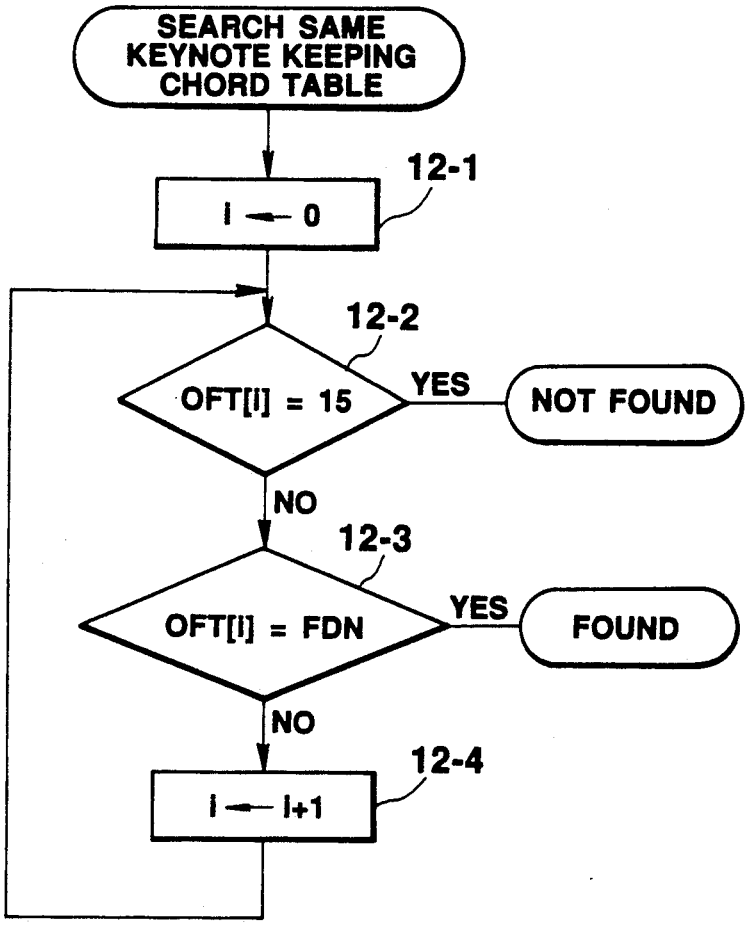
FIG. 12 is a flow chart of a routine of search same keynote keeping chord table.

FIG. 12 shows details of the search OFT routine 8-3, 8-4. Step 12-1 initializes the pointer i to "0" so as to locate the first address of the same keynote keeping chord table OFT. At step 12-3 in the loop 12-2 to 12-4, the search OFT routine compares an i-th element OFT[i] in the same keynote keeping chord table OFT with the new chord function name FDN evaluated by the current keynote (12-3). If matched at 12-3, the search OFT routine returns "found." If not matched, pointer i is incremented (12-4) to compare FDN with the next element in OFT table. If the same keynote keeping chord table does not includes an element matching the new chord function name FDN, the search OFT routine will see OFT[i]=15 indicative of end of OFT table (12-7) to return "not found" to step 8-5 in FIG. 8.

At step 8-5, CPU100 generates an old chord function name FDB in accordance with the current keynote $TDN_k$. Specifically CPU100 sets type variable $FDB_t$ to the old chord type CDBt, and computes an old chord scale degree $FDB_d$ by $(CDB_r+12-TDN_k)$ mod 12.

Then, CPU100 searches a relative key chord sequence table for the functional chord pattern of the old and new function names FDB and FDN(8-6, 8-7). The relative key chord sequence table resides in ROM102. FIG. 13 shows an example of the relative key chord sequence table, designated MCST. The relative key chord sequence table MCST stores a set of functional chord sequences each indicative of change from a major key to its relative minor key (e.g., C major to A minor) having the same key signature. According the memory map of FIG. 13 (see format), each two consecutive addresses in the relative key chord sequence table MCST store one functional chord pair entry indicative of change from a major key to its relative key, in which an even address stores a function name (scale degree and chord type) of the first chord in the functional chord pair while an odd address stores a function name of the second chord in the functional chord pair. The last address, here 84, in the table MCST stores data "15" indicative of end of the table.

If the relative key chord sequence table MCST includes an entry of functional chord sequence identical with the function name pattern (pair) of the old and new chord function names, it can be concluded that the combination of the old and new chords does indicate a change from major to minor key within the name key signature.

Figure 14:
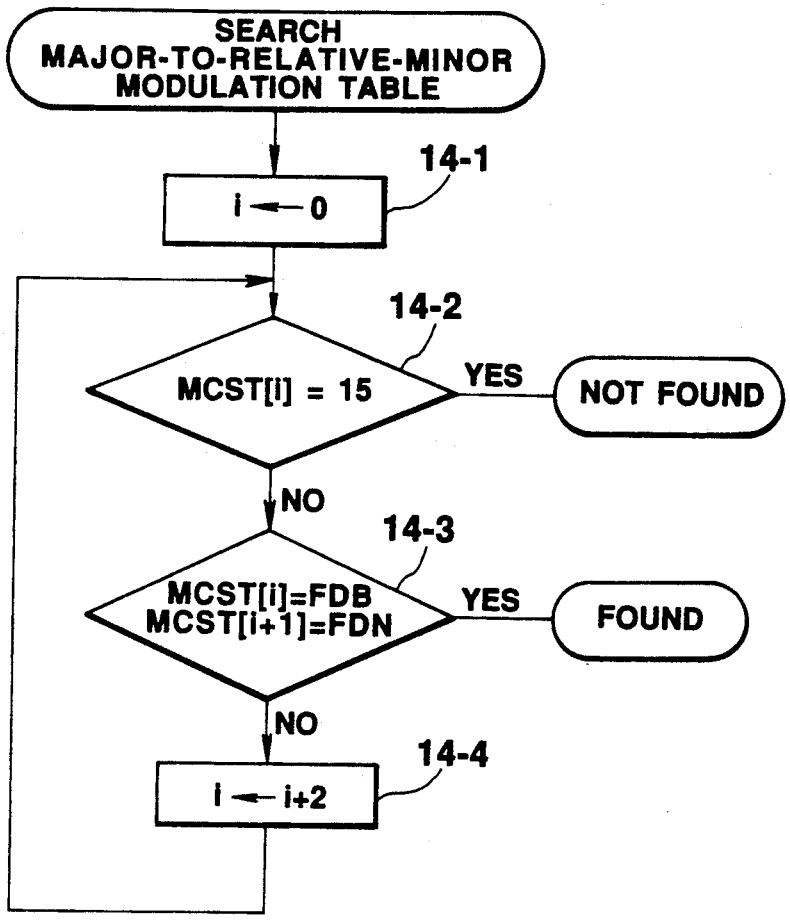
FIG. 14 is a flow chart of a routine of search major-to-relative-minor modulation table for a chord sequence of old and new chords.

FIG. 14 illustrates a detailed flow chart of the search MCST table routine 8-6, 8-7. At first (14-1), the search MCST table routine initializes the pointer i to "0" to locate the first address of MCST table. In the loop 14-2 to 14-4, at 14-3, the routine tests match/mismatch between a table entry of functional chord pattern and the pair of old and new chord function names by comparing an i-th table element MCST[i] with the old chord function name PDB and by comparing the next table element MCST[i+1] with the new chord function name FDN. If matched, the search routine successfully terminates by returning "found" so that the determine keynote and function routine (FIG. 8) will also be terminated. As a result, the keynote (here, key signature) in the new chord time interval is indicated by the current keynote $TDN_k$ while the correct function of the new chord is represented by FDN. If failed the matching test 14-3, the search MCST table routine increments the table address pointer i by two (14-4). If the relative key chord sequence table MCST does not include an entry identical with the functional chord pattern of the old and new chord function names FDB and FDN, the search MCST table routine will reach the table end (MCST[i]=15) at 14-2 so that the process will move to test pivot modulation routine 8-8, 8-9 in FIG. 8.

Figure 17:
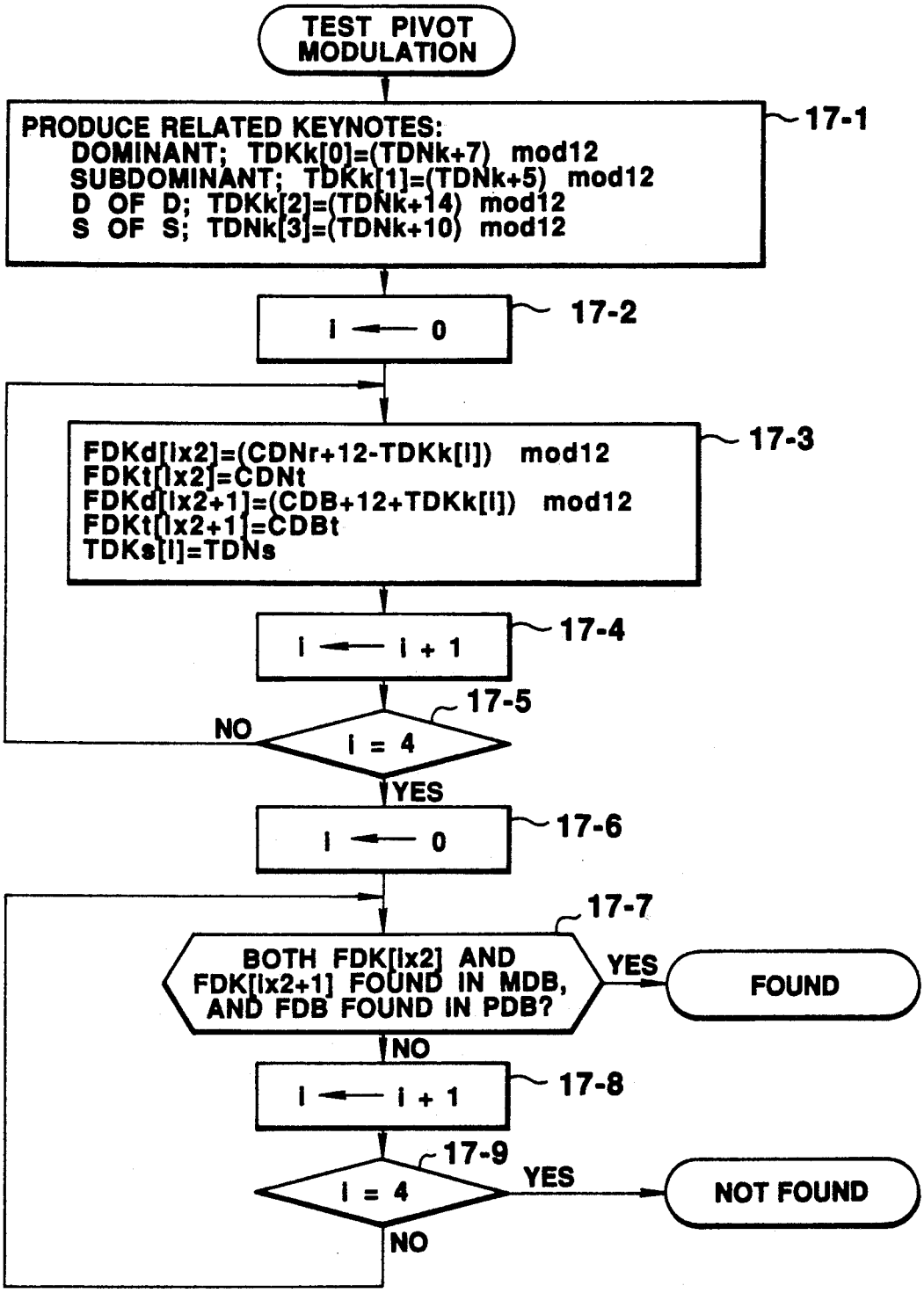
FIG. 17 is a flow chart of a routine of test pivot modulation which involves searching the pivot chord table and the post-modulation chord table.

The test pivot modulation routine examines a possible modulation by the old and new chords from the current keynote to another keynote. To this end, there is provided a modulation chord sequence table in ROM102. The modulation chord sequence table may be implemented by a pivot chord table PDB shown in FIG. 15 and a post-modulation chord table MDB shown in FIG. 16. The pivot chord table PDB stores a set of chord function names (degrees and types) available in a keynote before modulation. The post-modulation chord table MDB stores a set of chord function names available in a keynote after the modulation. FIG. 17 shows details of the test pivot modulation routine 8-8, 8-9. At first (17-1), the routine produces four related keynotes (i.e., dominant, subdominant, dominant of dominant, and subdominant of subdominant) of the current keynote $TDN_k$. As a result, (pitch class of) the dominant keynote is indicated by $TDK_k$[0], subdominant keynote by $TDK_k$[1], dominant of dominant keynote by $TDK_k$[2], and subdominant of subdominant keynote by $TDK_k$[3]. Then, the routine executes the loop 17-2 to 17-5 to produce four function names of the new and old chords, each name evaluated by a corresponding one of the four related keynotes. As a result, $FDK_k$[0] represents a new chord function name evaluated by the first related keynote, i.e., dominant keynote; the scale degree part of the new chord function name is indicated by $FDK_d$[0], and the type part by $FDK_t$[0]. Similarly, FDK[1] represents an old chord function name evaluated by the dominant keynote. FDK[2] and FDK[3] respectively represent new and old chord function names evaluated by the second related keynote (subdominant keynote), FDK[4] and FDK[5] respectively represent new and old function names evaluated by third related keynote (dominant of dominant keynote), and FDK[6] and FDK[7] respectively represent new and old function names evaluated by fourth related keynote (subdominant of subdominant keynote). Scale degree $FDK_d$[ix2] of the new chord, evaluated by the (i+1)-th related keynote is computed by ($CDN_r$+125−$TDK_k$[i]) mod 12 in which $CDN_r$ represents the new chord root, and $TDK_k$[i] indicates the (i+1)-th related keynote. Similarly, the scale degree $FDK_d$[ix2+1] of the old chord, evaluated by the (i+1)-th related keynote $TDK_k$[i] is computed by ($CDB_r$+12−$TDK_k$[i]) mod 12 in which $CDB_r$ represents the old chord root.

Figure 18:
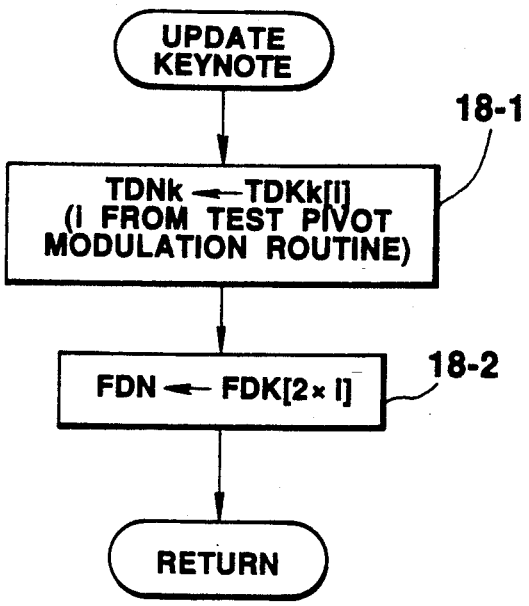
FIG. 18 is a flow chart of a routine of update keynote.

In the loop 17-6 to 17-9, CPU100 examines a possible modulation from the current keynote to any one of the four related keynotes for i=0 to 3. The chord sequence of the old and new chords CDB and CDN suggests a modulation to (i+1)-th related keynote if the following conditions are met (17-7). First, the pivot chord table PDB includes an entry identical with the old chord function name FDB evaluated by the current keynote $TDK_k$. Second, the pivot chord table PDB includes an entry identical with the old chord function name FDK[ix2+1] evaluated by the related keynote $TDK_k$[i]. Third, the post-modulation chord table MDB includes an entry identical with the new chord function name FDK[ix2] evaluated by the related keynote $TDK_k$[i]. If these conditions are all met, the test pivot modulation routine of FIG. 17 returns "found." At this point, $TDK_k$[i] has stored the correct keynote in the new chord time interval (i.e., one of the related keynotes that has satisfied the modulation conditions), while FDK[ix2] has stored the correct function of the new chord. Thus, CPU100 executes step 8-10 in FIG. 10 to update the current keynote. Details of step 8-10 are shown in FIG. 18 according to which $TDK_k$[i] is copied into $TDN_k$(18-1) and FDK[2xi] is copied into FDN. (18-2)

If the modulation conditions are not met for either related keynote, the test pivot modulation routine will see i=4 at 17-9 and terminate with "not found" so that the process is moved to direct conversion routine 8-11 in FIG. 8. This routine 8-11 is also executed when the current keynote has not yet been determined (8-1). The direct convertion routine 8-11 looks up a chord-to-function table residing in ROM102 to directly convert the new chord CDN to a function and determine a keynote of the new chord.

FIG. 19 exemplifies the chord-to-function table, designated CFR. An address of the table CFR indicates a chord type (see FIG. 6). Each address of the table CFR stores data of a function of a chord type indicated by the address.

Figure 20:
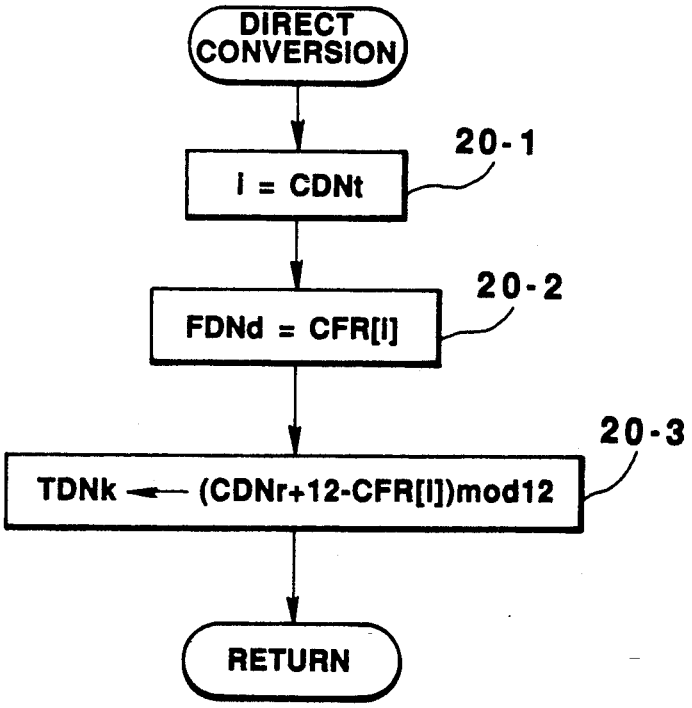
FIG. 20 is a flow chart of a direct conversion routine which determines a function and keynote of a new chord by referencing the chord-to-function table.

FIG. 20 depicts details of the direct conversion routine 8-11. The routine sets CFR table address pointer i to the new chord type $CDN_t$ (20-1), and sets the new chord function (degree) variable $FDN_d$ to the table element CFR[i] specified by the pointer i(20-2). Then, using the new chord function CFR[i] and the new chord root $CDN_r$, the direct conversion routine computes a keynote $TKN_k$ in the new chord time interval by ($CDN_r$+12−CFR[i]) mod 12 (20-3).

By way of example, let us take up a chord progression of C major → D minor → G minor → D♭ major. For this chord progression, the determine keynote and function routine operates as follows. For C major chord, no current keynote has been determined at the entry to the flow of FIG. 8 since the C major is the first chord in the chord progression. At step 8-11, the function of the first chord C major is determined to be I (tonic), and the keynote in the C major chord time interval is specified by C. At the time when the second chord D minor is given, the current keynote data $TDN_k$ is "0", indicating the keynote C. From the current keynote=C, step 8-2 assumes II minor as the D minor chord function name. Since the II minor (data 2,6) matches a table element at address 4 of the same keynote keeping chord table OFT (8-3, 8-4), the function of the second chord D minor is determined to be II (supertonic). Thus, the keynote C that was applied to the first chord time interval continues in the second chord time interval. From the keynote C, the third chord G minor in the chord progression appears to have a function name V minor (8-2) which is represented by data (7, 6). This function name data (7, 6), however, is not found in the same keynote keeping chord table OFT (8-3, 8-4). Evaluating the second and third chords by the keynote (key signature) C yields a function name sequence of II minor → V minor. However, this sequence, which is represented by data (2, 6; 7, 6), is not found either in the relative key chord sequence table MCST (8-6, 8-7). Assuming a related keynote F which is the subdominant of the keynote C, the chord sequence of D minor → G minor is evaluated as a function name sequence of VI minor → II minor. This function name sequence is represented by data (9, 6) and (2, 6). The data (9, 6) matches a table element MDB[5] at address 5 of the post-modulation chord table MDB, and the data (2, 6) matches a table element MDB[1] at address 1 of the table MDB. Further a second chord function name II minor or data (2, 6) evaluated by keynote C matches a table entry PDB [1] of the pivot chord table PDB at address 1. Thus, a modulation from keynote C to F is detected (8-8, 8-9). The function of the third chord G minor is now determined to be II, and the keynote in the third chord time interval is found to be F. With the current keynote F, the fourth chord D♭ major is given. In this case, all searches 8-3, 8-6 and 8-8 result in failure. Thus, the direct convertion 8-11 is executed to determine that the fourth chord D♭ major functions as I with keynote D♭.

In this manner, the chord progression of C major→D minor→G minor→D♭ major is found to have a function progression of I→II→II→I with a keynote progression of C→C→F→D♭.

Figure 22:
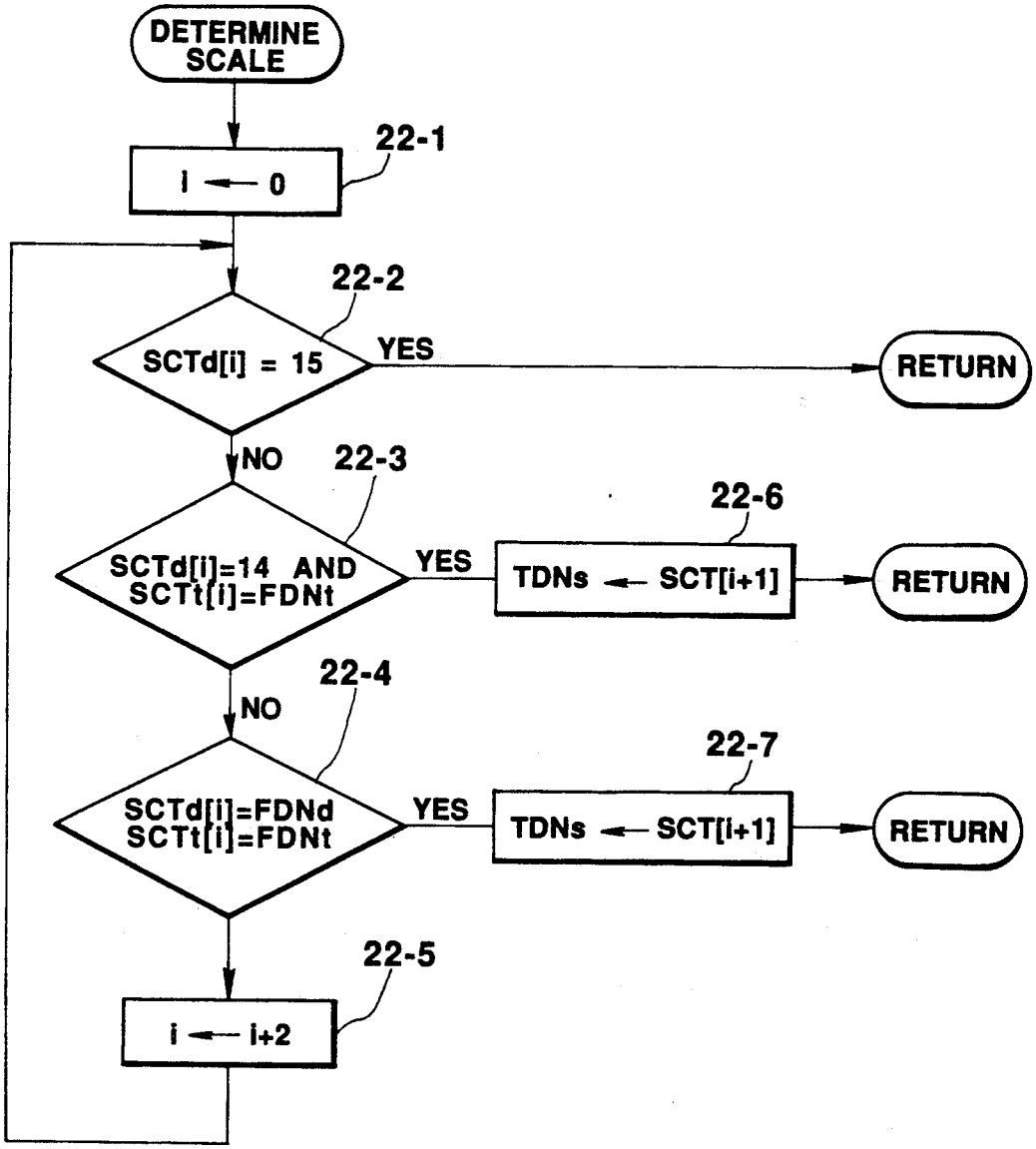
FIG. 22 is a flow chart of a determine scale routine.

FIG. 22 shows a flow chart of a determine scale routine executed in the tonality generating process 4-4. This routine looks up a scale table placed in ROM102 to covert a new chord function name FDN obtained from the determine keynote and function routine into a corresponding scale name $TDN_s$. FIG. 21 exemplifies the scale table, designated SCT. The scale table SCT stores correspondence between chord function names (degrees and types) and scales. According to the memory map of FIG. 21 (see format), an even address of the table SCT stores one chord function name (degree and type), and the odd address next to the even address stores a scale name corresponding to that chord function name. For example, address 6 stores a chord function name Vmajor, represented by data (7, 0) while the next address 7 stores a mixolydian scale, represented by data 2. However, special chords (key independent chords) such as augmented, diminished and suspended fourth chords at addresses 60, 62, and 64 may specify a scale independent of their root scale degree from the keynote. To indicate this, each degree part of these addresses stores data "14." The last address, here, 66 of the table SCT stores a code "15" indicative of the table end.

FIG. 22 shows a detailed flow chart of the determine scale routine. At the entry to this routine, FDN has stored the correct function name of the new chord, as a result of the determine keynote and function routine of FIG. 8. $FDN_d$ indicates the new chord scale degree, and $FDN_t$ indicates the new chord type.

At first (22-1), CPU100 initializes the pointer i to "0" to locate the start address of the scale table SCT. In the loop 22-2 to 22-5, the pointer i is incremented two by two (22-5) from the table start (i=0) to the table end (SCTd[i]=15). Step 22-4 compares the new chord function name FDN with a table element SCT[i] specified by the pointer i. If matched, the next table element scale data SCT[i+1] is loaded into scale part $TDN_s$ of the tonality data memory TDN(22-7). If the new chord is a special chord (either of augmented, diminished and suspended fourth), the determine scale routine will find a table element SCT[i] having $SCT_t$[i] data identical with the new chord type $FDN_t$, and $SCT_d$[i] data of "14" indicative of the special chord (22-3). Then, the scale data of the next table element SCT[i+1] is loaded into scale part $TDN_s$ of the tonality data memory TDN (22-6).

The tonality data memory TDN now stores tonality data defining a pitch class set available in the new chord time interval. The keynote part $TDN_k$ of the memory TDN stores keynote data indicative of the keynote pitch class in the new chord time interval, and the scale part $TDN_s$ stores scale data indicative of the scale in the new chord time interval.

FIG. 23 illustrates a scale member table SKT residing in ROM102. The scale member table SKT stores scale member data written in keynote C for each scale. For example, ionian scale member data stored at addresses 0 to 6 have respective values 0, 2, 4, 5, 7, 9 and 11 which indicate pitch classes C, D, E, F, G, A and B, respectively. FIG. 24 illustrates a table of scale identification data. The storage allocation of the scale member table SKT is such that the size of storage for members of each scale is uniformely given by the maximum number of scale members (e.g., 8). Dummy data is provided for those scales having a number of members less than the maximum number. With this storage allocation, if scale data specifying a scale is given, then the scale members of that scale are obtained by reading data from the scale member table SKT, starting from an address specified by 8 times the scale data until dummy data is found or for the size of 8.

Thus, CPU100 uses scale part $TDN_s$ of the tonality data memory TDN to read from the scale member table corresponding member pitch classes of the scale specified by $TDN_s$. These pitch classes are denoted by SKT[7×$TDN_s$] to SKT[7×$TDN_s$+n], where n indicates the number of the members minus 1. Then, CPU100 transposes the read pitch classes by the keynote indicated by the keynote part $TDN_k$ of the tonality data memory TDN to thereby obtain individual pitch classes, denoted PC[0] to PC[n], available in the new chord time interval by:

$$PC[1]=(SKT[7\times TDN_s]+TDN_k) \bmod 12,$$

$$PC[2]=(SKT[7\times TDN_s+1]+TDN_k) \bmod 12,$$

and so on, and $$PC[n]=(SKT[7\times TDN_s+n]+TDN_k) \bmod 12.$$

CPU100 may control the display device 114 at step 3-4 to display these available pitch classes. Guided by the displayed available pitch classes, a user may wish to perform improvization by the keyboard in the input device 100.

Figure 25:
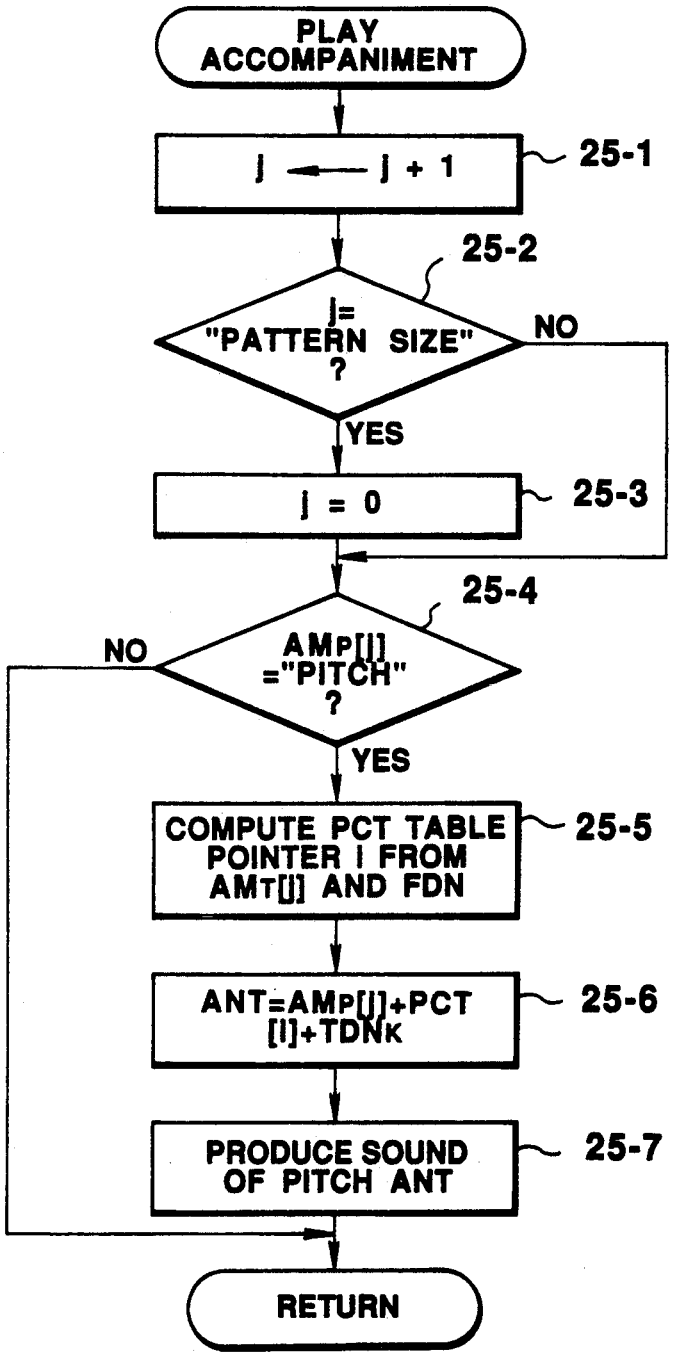
FIG. 25 is a flow chart of a play accompaniment routine.
Figure 26:
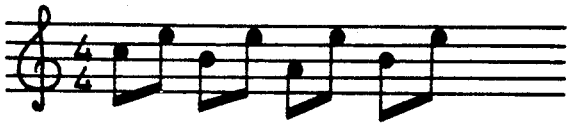
FIG. 26 is a staff illustrating an accompaniment pattern.

FIG. 25 shows a detailed flow chart of the play accompaniment routine 4-5 in FIG. 4. FIG. 26 illustrates a reference accompaniment pattern used in the play accompaniment routine, as a basis for accompaniment. This accompaniment pattern is written in keynote C and suitable for a chord function name of I major. FIG. 27 depicts an accompaniment pattern memory AM (residing in ROM102) which stores data representative of the reference accompaniment pattern in FIG. 26. Specifically, each address of the accompaniment pattern memory AM stores data that comprises a first part $AM_P$ indicative of a pitch (if any) and a second part $AM_T$ indicative of a column pointer of a pitch modifying table PCT shown in FIG. 28 (if any). CPU100 repeatedly reads the accompaniment pattern memory AM in accordance with the flow of FIG. 25. If the first part of the read data indicates a pitch, CPU100 modifies that pitch in accordance with the chord function name FDN and in accordance with the keynote, and sends the modified pitch data to the tone generator 108 to produce an accompaniment tone of the modified pitch.

The pitch modifying table PCT in FIG. 28 stores entries of pitch modifying data indicative of a pitch difference for modifying pitch data from the accompaniment pattern memory AM in accordance with the new chord function name (degree and type). Since the pitch contents of the accompaniment pattern memory AM are designed to be suitable for a chord function name of I major, the first row of the pitch modifying table PCT, denoted major I, stores a series of data "0" indicative of no pitch change. However, for a function name other than I major, for example, V major, the pitch data (e.g., C5) stored in the accompaniment pattern memory, which is designed to be suitable for I major function name, should be modified so that the modified pitch data will be suitable for V major. According to the accompaniment pattern memory AM of FIG. 27, the column pointer associated with pitch C5 specifies column "0" of the pitch change table PCT. The intersection between row "major V" and column "0" stores data "−1" indicative of lowering pitch by a half tone. Therefore, for the function name V major, pitch data of "C5" read out from the accompaniment pattern memory AM is lowered by a half tone to pitch data of "B4."

At step 25-1 in the play accompaniment routine, CPU100 increments an accompaniment pattern pointer j by one. If the pointer j has reached the accompaniment pattern memory AM size (16 in the case of FIG. 27) at step 25-2, the pointer j returns to the start of the accompaniment pattern memory AM (25-3). Then CPU100 checks if the first part $AM_P[j]$ of the data AM[j] in the accompaniment pattern memory AM at a location specified by pointer j indicates a pitch. If this is not the case, the play accompaniment routine directly terminates. If $AM_P[j]$ indicates a pitch, CPU100 computes an address pointer i of the pitch modifying table PCT from the column pointer $AM_T[j]$ and the new chord function name FDN (step 25-5). Then CPU100 adds the pitch difference data PCT[i] from the pitch modifying table PCT and the current keynote data from the current keynote memory $TDN_k$ to the pitch data $AM_P[j]$ from the accompaniment pattern memory AM to thereby obtain data ANT indicative of an actual accompaniment tone pitch (step 25-6). In the equation:

$$ANT=AM_P[j]+PCT[i]+TDN_k,$$

the term ($AM_P[j]+PCT[i]$) indicates an accompaniment pitch for keynote C and chord function name FDN. ANT represents a pitch suitable for the chord function and keynote obtained in the determine keynote and function routine of FIG. 8. Finally (25-7), CPU100 sends a note-on command including the pitch data ANT thus produced to the tone generator 108 to synthersize an accompaniment tone having the corresponding pitch (25-7).

Figure 29:
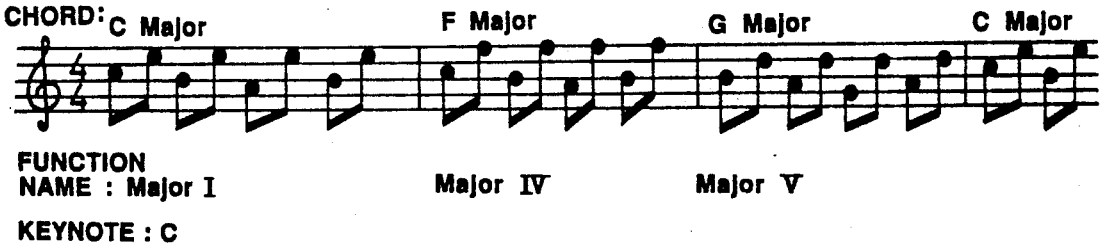
FIG. 29 illustrates an accompaniment played by the specific embodiment.

FIG. 29 illustrates an accompaniment example played by the automatic accompaniment apparatus of the specific embodiment in response to a chord progression of:

C major→F major→G major→C major.

This chord progression is analyzed by the determine keynote and function routine (FIG. 8), resulting in keynote C and a function name progression of:

I major→IV major→V major→I major

Thus, an accompaniment segment in each C major chord time interval is formed without changing the pitch line from the accompaniment pattern memory AM. The stored pitch line is as follows:

C5→E5→B4→E5→A4→E5→B4→E5

In the F major chord time interval, however, the E5 pitch in the stored pitch line is raised by a half tone to F5 in accordance with the pitch difference data "1" in the pitch modifying table PCT because the F major chord has been evaluated as function name major IV. As a result, an accompaniment segment in the F major chord time interval will have a pitch line of:

C5→F5→B4→F5→A4→F5→B4→F5

For the G major chord, C5 pitch in the stored pitch line is lowered by a half tone to B4 in accordance with pitch difference data "−1", and E5, B4 and A4 pitches are lowered by a whole tone to D5, A4 and G4 respectively in accordance with pitch difference data "−2" because the G major chord function name is major V. As a result, an accompaniment segment in the G major chord time interval will have a pitch line of:

B4→D5→A4→D5→G4→D5→A4→D5

In this manner, the described automatic accompaniment performing apparatus analyzes a given chord progression with respect to tonality and automatically forms an accompaniment line suitable for tonality in each chord time interval. Unlike the prior art, the present apparatus surely avoids generation of a discord pitch sound in accompaniment which is caused by forming an accompaniment depending only on a chord root and type. If a reference stored accompaniment pattern written for a reference chord root and type is pitch-modulated by a detected chord root and type to form an accompaniment, as employed in the prior art, then the resultant pitch (local pitch range) of the accompaniment is forced to change correspondingly depending on the progression of chord root pitches. In contrast, the accompaniment apparatus of the invention can control the local pitch range of the accompaniment in accordance with tonality or function of chord, thus providing a desired pitch line of accompaniment over the entire period of the chord progression.

This concludes the detailed description of the illustrative embodiments. However, various modifications and variations will be obvious to a person having ordinary skill in the art without departing from the scope of the invention.

Figure 30:
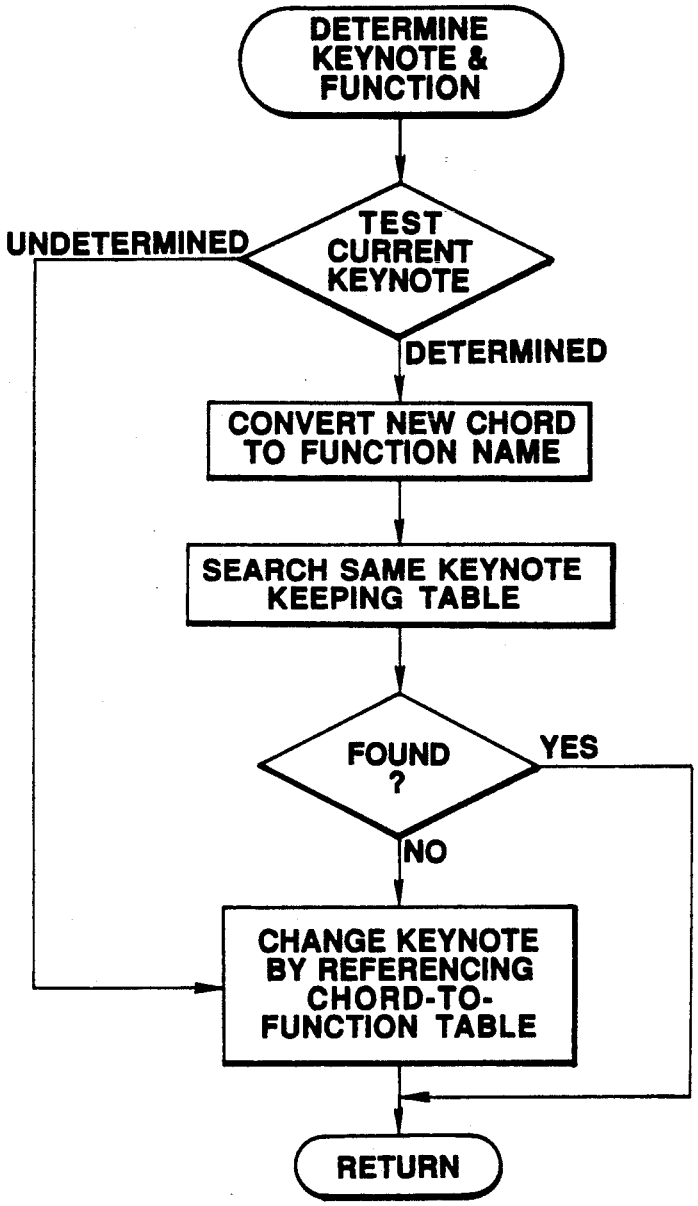
FIG. 30 is a flow chart of a modified routine of determine keynote and function.

FIG. 30 depicts a first modification of the determine keynote and function routine of FIG. 8. The modified routine omits blocks 8-5 to 8-9 for testing relative minor key and for testing pivot modulation. Thus, if the search of the same keynote keeping chord table ends in failure, the modified routine directly looks up the chord-to-function table to obtain a new chord function and keynote.

Figure 31:
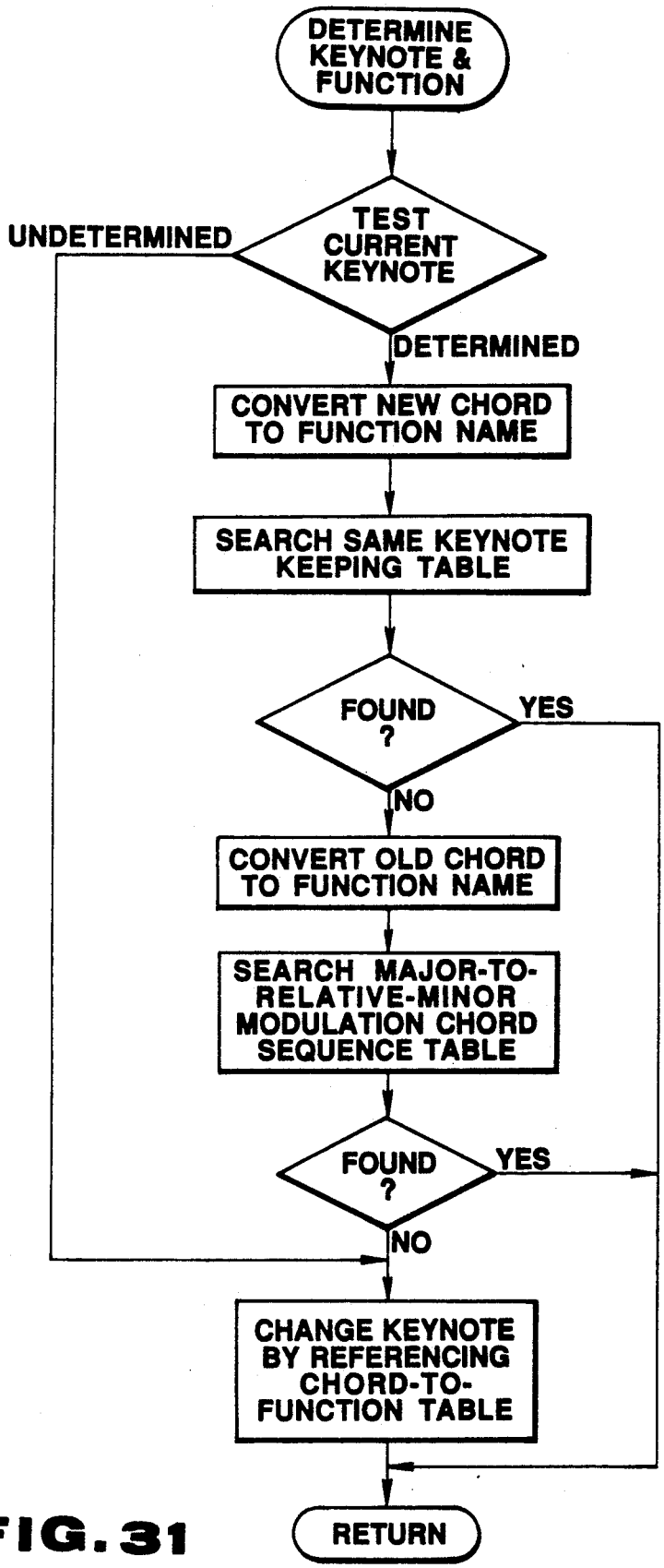
FIG. 31 is a flow chart of another modified routine of determine keynote and function.

FIG. 31 shows a second modification of the determine keynote and function routine. This modification omits blocks 8-8 and 8-9 for testing pivot modulation. Thus, if the test of relative minor key result in failure, the second modified routine directly looks up the chord-to-function table to determine a new chord function and keynote.

Figure 32:
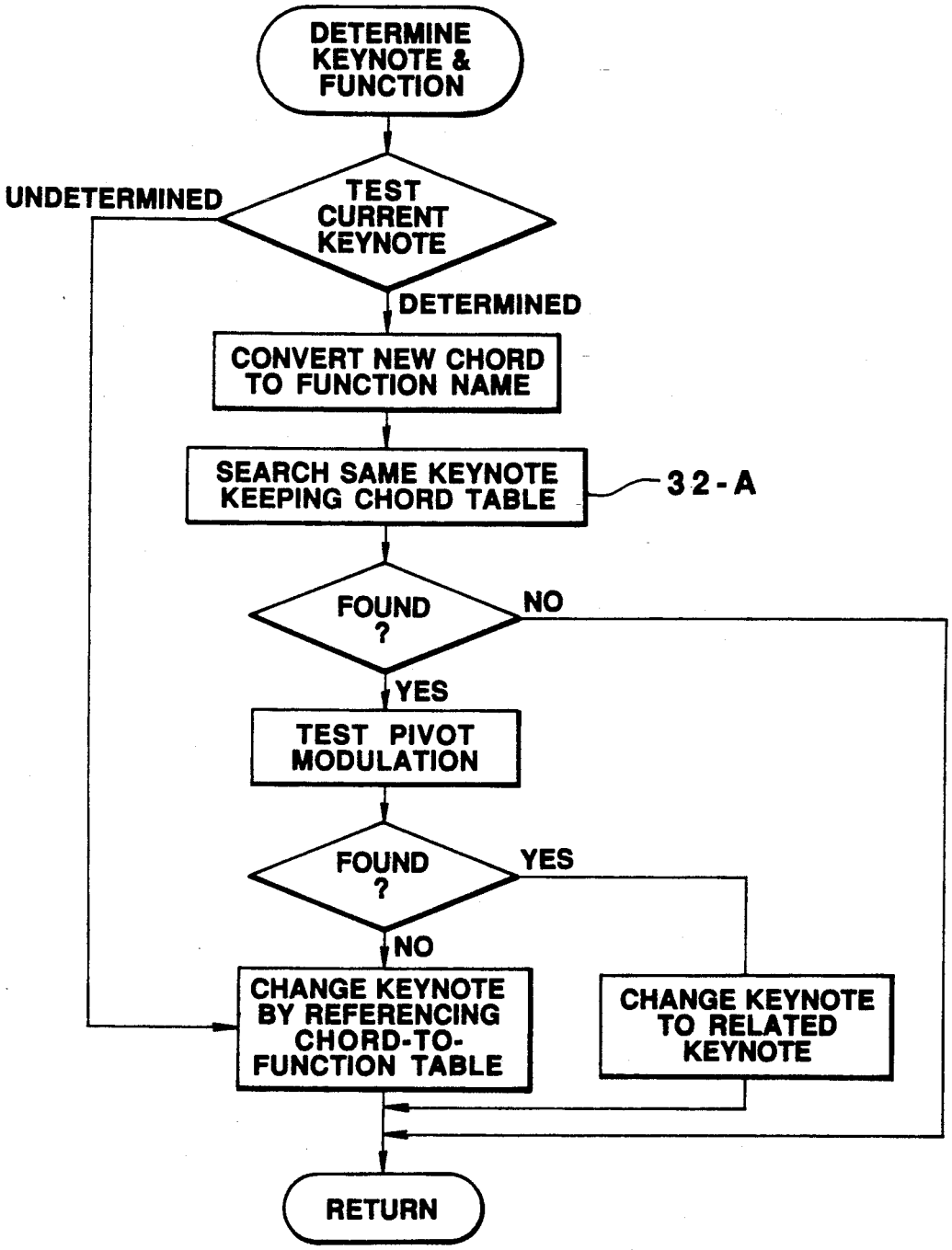
FIG. 32 is a flow chart of a further modified routine of determine keynote and function.

FIG. 32 depicts a third modification of the determine keynote and function routine. In form, the third modification omits blocks 8-5 to 8-7 for detecting a change from a major key to its relative minor key having the same key signature. If the search of the same keynote keeping chord table ends in failure, the third modified routine tests a possible pivot modulation. However, block 32-A may search a modified same keynote keeping chord table which stores a set of chords keeping the current key signature unchanged. Using such modified table, the routine of FIG. 32 provides a chord progression analysis similar to that obtained by the routine of FIG. 8 which searches both of the same keynote keeping chord table OFT (FIG. 11) and the relative key chord sequence table MCST (FIG. 13). FIG. 33 exemplifies the modified same keynote (key signature) keeping chord table, designated DOFT. In the table DOFT, each of chord function names III, III7 and III7SUS4 suggests a minor key. With the current key of C major, if a new chord of E, E7 or E7SUS4 is given, its function name is specified by III, III7 or III7SUS4, respectively. Thus, the new chord indicates A minor key having the same key signature as C major key.

Figure 34:
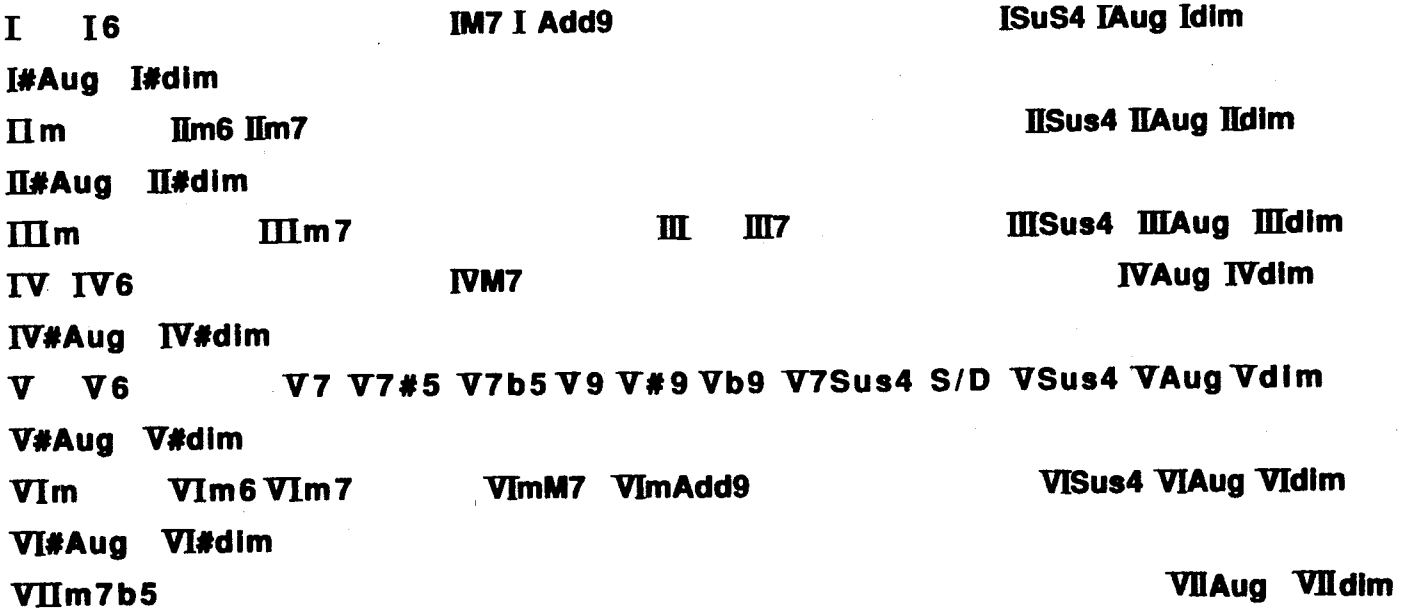
FIG. 34 illustrates another modification of the same keynote keeping chord table.

FIG. 34 shows another modified same keynote keeping chord table, designated FOFT. A feature of this table FOFT is that it contains a plurality of function names for special chords of diminished (dim) and augmented (Aug). Further the table FOFT includes additional function names for the suspended fourth (SUS 4) chord. Thus the table FOFT enables determining the function and keynote of special chords such as dim, Aug and SUS4.

To form an accompaniment from a chord and tonality progression, either of the following three modified accompaniment apparatus may be employed in accordance with the invention.

The first modified accompaniment apparatus uses results from the keynote and function determining process for every segment of the accompaniment. To this end there is provided a plurality of accompaniment patterns for respective chord function names such that they are different from one another according to the function names. Every accompaniment pattern is written in keynote C. In operation, when a chord function name is provided by the keynote and function determining process, the first modified accompaniment apparatus generates an accompaniment pattern corresponding to and unique to that chord function name, and transposes the generated accompaniment pattern in accordance with a keynote from the keynote and function determining process.

Figure 35:
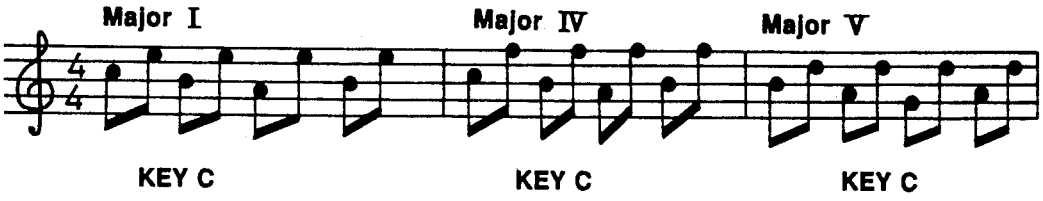
FIG. 35 shows accompaniment pattern examples generated in a first modification of the automatic accompaniment performing apparatus.
Figure 36:
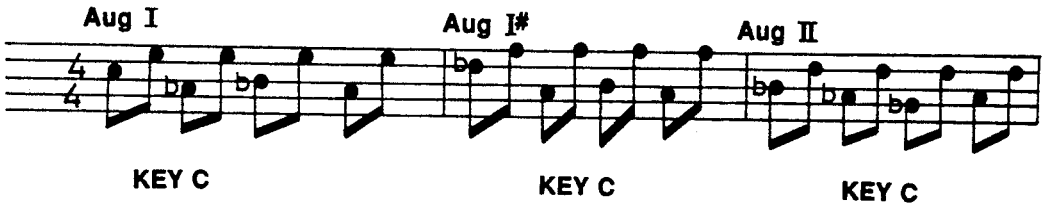
FIG. 36 shows further accompaniment pattern examples generated in the first modification of the automatic accompaniment performing apparatus.

FIGS. 35 and 36 depict accompaniment pattern examples used in the first modified accompaniment apparatus for three different functions I, IV, V of major chord while FIG. 36 shows accompaniment patterns for three different functions I, I♯, II of an augmented chord. It should be noted that all accompaniment patterns are written in a single common keynote C. This facilitates writing of accompaniment patterns by a pattern writer.

These accompaniment patterns can be generated by modifying the pitch contents of the accompaniment pattern memory AM of FIG. 27 (storing the accompaniment pattern illustrated in FIG. 26) by a pitch change table KPCT illustrated in FIG. 37.

In FIG. 37, a row of the pitch change table KPCT represents a chord function name. A column of the table KPCT is specified by a table column pointer from the accompaniment pattern memory AM. In the pitch change table KPCT, rows of major I, major IV and major V store (0, 0, 0, 0), (0, 1, 0, 0), and (−1, −2, −2, −2), respectively at columns 0 to 3. The data "0", "1", "−1" and "−2" respectively indicate no change, raise by half tone, lower by half tone, and lower by whole tone, a pitch from the accompaniment pattern memory AM. Thus, modifying the accompaniment pattern in the memory AM by these row data in the table KPCT will form accompaniment patterns illustrated in FIG. 35 for chord function names major I, major IV and major V.

In the table KPCT, rows of AugI, AugI♯ and AugII store data (0, 0, −3, 1), (1, 1, −2, 2), and (−2, −2, −3, −3) at columns 0 to 3. The accompaniment patterns illustrated in FIG. 36 for the chord function names of AugI, AugI♯ and AugII will be formed by modifying the accompaniment pattern from the memory AM by these row data.

Figure 38:
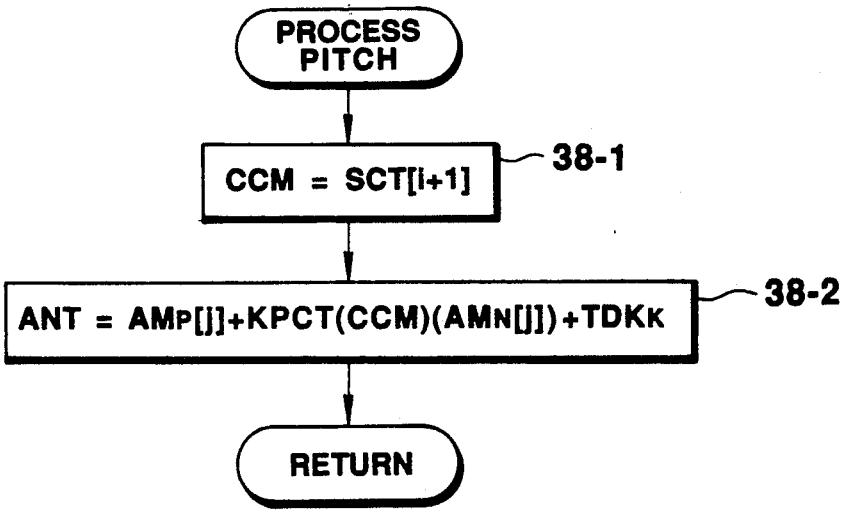
FIG. 38 is a flow chart of a process pitch routine executed in the first modification of the automatic accompaniment performing apparatus.
Figure 39:
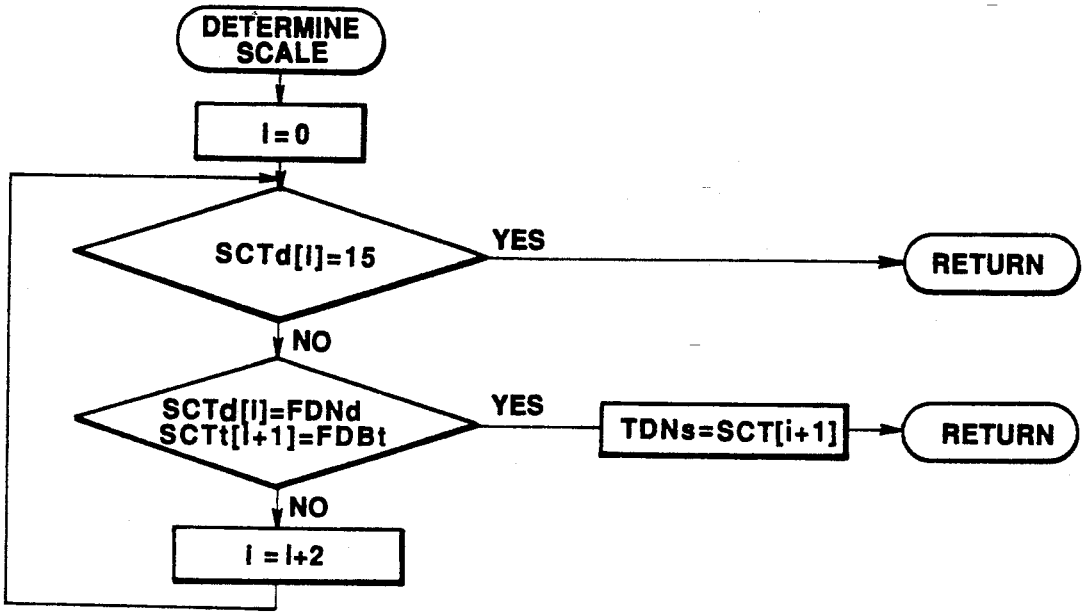
FIG. 39 is a flow chart of a determine scale routine executed in the first modification of the automatic accompaniment performing apparatus.

FIG. 38 shows a process pitch routine for producing an actual accompaniment pitch in accordance with the first modified accompaniment apparatus. Step 38-1 sets CCM to scale data SCT[i+1] to locate a row of the pitch change table KPCT. This scale data SCT[i+1] has been obtained in the flow of FIG. 39. A scale table SCT looked up in the flow of FIG. 39 is different from the scale table illustrated in FIG. 21, and contains scale data entries for all chord function names.

As indicated at step 38-2 of FIG. 38, an actual accompaniment tone pitch ANT is given by:

$$ANT = AM_P[j] + KPCT(CCM)\ (AM_N[j] + TDK_k)$$

in which $AM_P[j]$ is pitch data from the accompaniment pattern memory AM, CCM specifies a row number of the pitch change table KPCT and is given by the scale data SCT[i+1], $AM_N[j]$ is a column pointer associated with $AM_P[j]$ and specifies a column number of the pitch change table KPCT, and $TDK_k$ indicates a keynote.

The second modified accompaniment apparatus classifies chords into a first chord group (key relevant chord group) and a second chord group (key independent chord group). In a time interval of a chord pertaining to the first chord group, the accompaniment apparatus uses results from the keynote and function determining process to generate an accompaniment pattern suitable for a chord function. The generated accompaniment pattern is written in keynote C. Then, the accompaniment apparatus transposes the generated accompaniment pattern in accordance with a keynote from the keynote and function determining process to produce an actual accompaniment. For a chord pertaining to the second chord group, the accompaniment apparatus generates an accompaniment pattern suitable for the chord type without using results from the keynote and function determining process. The generated accompaniment pattern is represented in chord root C. Then, the accompaniment apparatus shifts the pitch contents of the generated accompaniment pattern in accordance with a chord root from the chord progression input device.

Specifically, the second modified accompaniment apparatus looks up a scale table SCT such as the one illustrated in FIG. 21. According to the scale table SCT, chords of Aug, dim and SUS4 pertain to the second chord group while the remaining chords belong to the first chord group. FIG. 22 shows a determine scale routine which includes identifying a chord group. A chord pertaining to the second group is detected at step 22-3, and scale data SCT[i+1] corresponding to the type of that chord is obtained at step 22-6. A chord pertaining to the first chord group is detected at step 22-4, and scale data SCT[i+1] corresponding to the function neme of that chord is obtained at step 22-7. Scale data SCT[i+1] corresponding to a first group chord type is used to generate an accompaniment pattern in the time interval of that first group chord while scale data SCT[i+1] corresponding to a second group chord function name is used to generate an accompaniment pattern in the time interval of that second group chord.

As stated, accompaniment patterns generated for the first chord group are all written in a single common keynote C as in the first modified accompaniment apparatus to facilitate their pattern writing by a pattern writer (see FIG. 35). On the other hands those accompaniment patterns generated for the second chord group are written in a chord root C (see FIG. 40).

Figure 40:
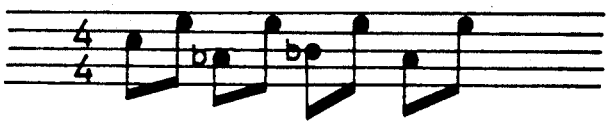
FIG. 40 illustrates an accompaniment pattern example generated in a second modification of the automatic accompaniment performing apparatus.

FIG. 40 illustrates a single accompaniment pattern generated in response to Aug chord which pertains to the second chord group (key independent chord group) in accordance with the second modified accompaniment apparatus. The first modified accompaniment apparatus requires a plurality of accompaniment patterns for all possible functions of Aug chord (see FIG. 36). In contrast, the second modified accompaniment needs only to generate a single accompaniment pattern in response to a chord pertaining to the second chord group, irrespective of a function of the chord. This will lighten a pattern writer's burden and save storage capacity.

Figure 42:
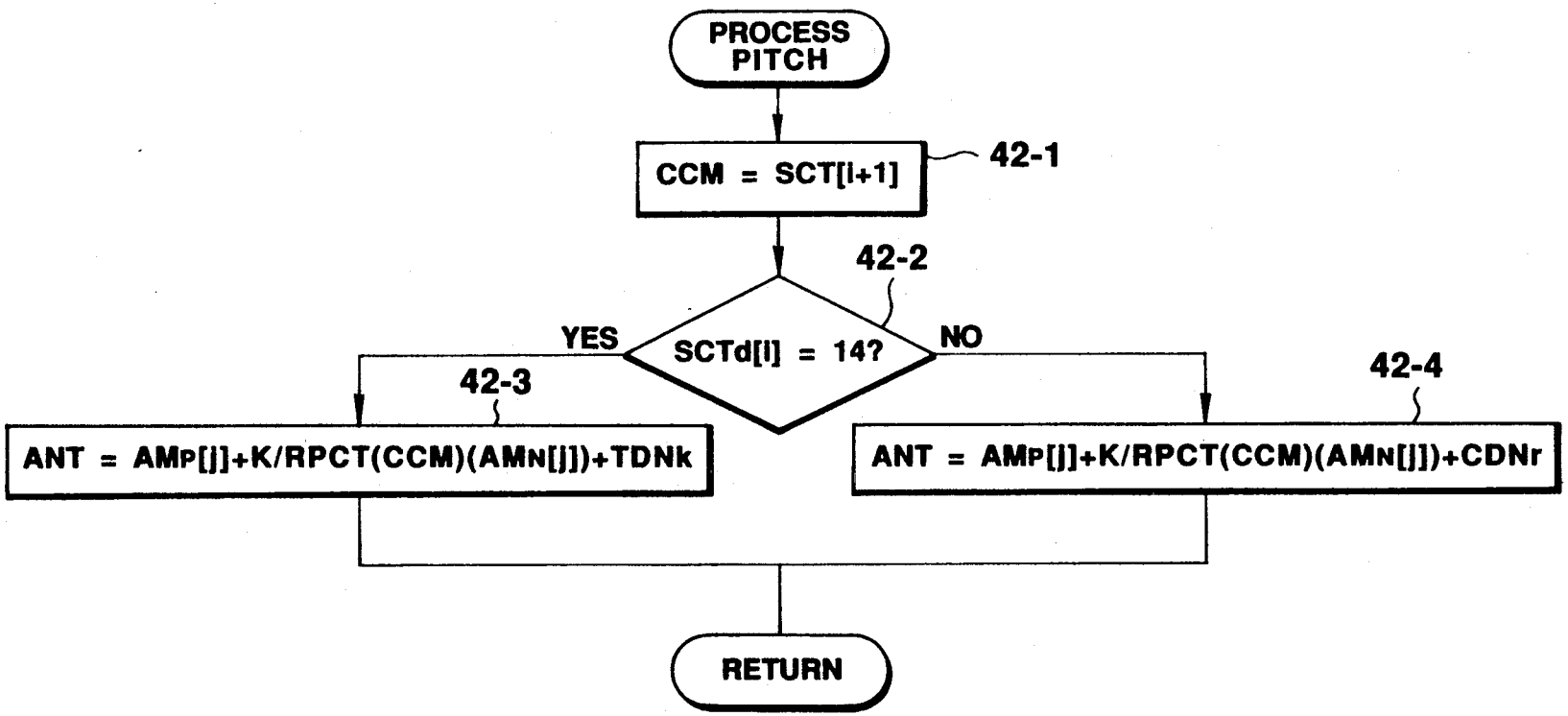
FIG. 42 is a flow chart of a process pitch routine executed in the second modification of the automatic accompaniment performing apparatus.

FIG. 41 illustrates a pitch change table, designated K/RPCT in accordance with the second modified accompaniment apparatus. FIG. 42 shows a process pitch routine executed in the second modified accompaniment apparatus. Step 42-1 locates a row of the pitch change table K/RPCT by setting CCM to the scale data SCT[i+1] obtained from the determine scale routine of FIG. 22. If a chord of interest pertains to the first chord group (42-2), step 42-3 produces an actual accompaniment tone pitch ANT by:

$$ANT = AM_P[j] + K/RPCT(CCM)(AM_N[j]) + TDN_k$$

In this manner, an accompaniment tone pitch for a first group chord is obtained by modifying pitch data $AM_P[j]$ from the accompaniment pattern memory AM(-FIG. 27) with pitch difference data in the pitch change table K/RPCT at CCM-th row and at $AM_N[j]$-th column, and by further adding keynote data $TDN_k$ from the keynote and function determining process (FIG. 8). If the chord of interest belongs to the second chord group, step 42-4 produces an actual accompaniment tone pitch ANT by:

$$ANT = AM_P[j] + K/PRCT(CCM)(AM_N[j]) + CDN_r$$

In this manner, an accompaniment tone pitch for a second group chord is obtained by adding chord root data $CDN_r$ from the chord progression input device after modifying pitch data $AM_P[j]$ from the accompaniment pattern memory AM with pitch difference data in the pitch change table K/RPCT at the intersection of CCM-th row and $AM_N[j]$-th column.

Figure 43:
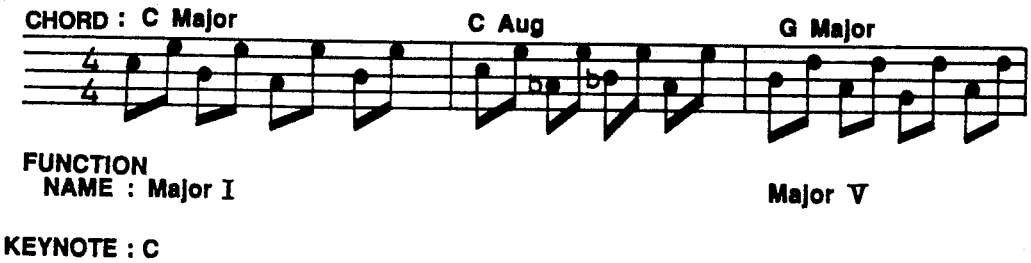
FIG. 43 illustrates an accompaniment played by the second modification of the automatic accompaniment performing apparatus.

FIG. 43 shows an example of accompaniment played by the second modified accompaniment apparatus.

Figure 44:
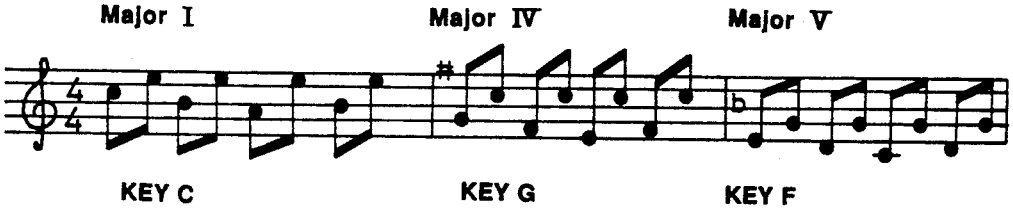
FIG. 44 illustrates accompaniment pattern examples generated in a third modification of the automatic accompaniment performing apparatus.

The third modified accompaniment apparatus classifies chords into the first and second chord groups in a similar manner to the second modified accompaniment apparatus. Also, the third modified accompaniment apparatus forms an accompaniment in the time interval of a first group chord by using results from the keynote and function determining process while it forms an accompaniment in the time interval of a second group chord without using results from the keynote and function determining process. However, unlike the second modified apparatus, the third modified accompaniment apparatus generates, for the first chord group, accompaniment patterns which are written in a common chord root C instead of the common keynote C. In other words, the accompaniment patterns are written in different keynotes according to chord functions. An example is shown in FIG. 44. As illustrated, an accompaniment pattern for chord function name major I is written in keynote C. However, an accompaniment pattern for chord function name of major IV is written in key G, and an accompaniment pattern for chord function name of major V is written in key F.

FIG. 45 shows a pitch change table RPCT for use in the third modified accompaniment apparatus. The lowest three rows of the table RPCT store pitch difference data to be used in generating accompaniment patterns for the second chord group. Chords of SUS4, dim and Aug constitute the second chord group.

Figure 46:
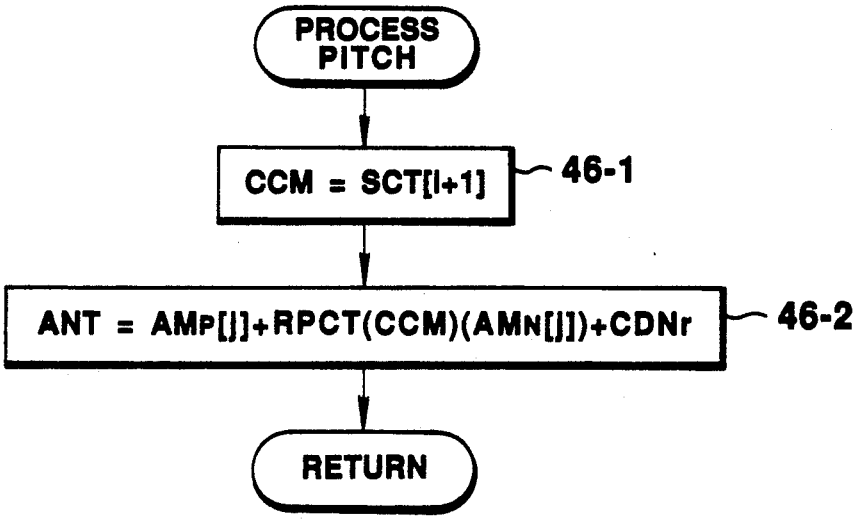
FIG. 46 is a flow chart of a process pitch routine executed in the third modification of the automatic accompaniment performing apparatus.

FIG. 46 is a process pitch routine executed in the third modified accompaniment apparatus. Step 46-1 sets CCM to scale data SCT[i+1] to locate a row of the pitch change table RPCT. If a chord of interest belongs to the first chord group the scale data SCT[i+1] indicates the function name of that chord. For a second group chord the scale data SCT[i+1] indicates the type of the chord. Step 46-2 produces an actual accompaniment tone pitch ANT by:

$$ANT = AM_P[j] + RPCT(CCM)(AM_N[j]) + CDN_r$$

That is, the actual pitch is obtained by adding chord root data $CDN_r$ from the chord progression input device after modulating pitch data $AM_P[j]$ from the accompaniment pattern memory AM(FIG. 27) with pitch difference data in the pitch change table RPCT at the intersection of CCM-th row and $AM_N[j]$-th column.

Like the second modification, the third modified accompaniment apparatus has the advantage of saving the storage capacity of pitch change table.

In the specific embodiment of the invention, matching test between a function knowledge table entry and an input chord is carried out by comparing their function names. In the alternative, a routine of searching a function knowledge table e.g., same keynote keeping chord table may use a keynote of a new chord (which is assumed to be a current keynote) to convert each table entry of function name to a chord name having a root and type so that each converted chord name is compared with the input chord root and type. This arrangement eliminates function name generating means which converts an input chord represented by a root and a type to a function name represented by a function and a type.

The following arrangement will also eliminate function generating means such as modules 38, 48, 50 and 52 in FIG. 1A. For all possible keynote pitch classes from C to B, there are provided a plurality of function knowledge chord tables each associated with a different one of the keynote pitch classes. Each function knowledge table (e.g., same keynote keeping chord table, modulation chord table) store a set of chords or chord sequences in which each chord is represented by a root and type instead of function name. When examining a possible maintenance of keynote, a same keynote keeping chord table associated with a current keynote pitch class is searched to find a chord entry identical with a newly input chord root and type. If such a chord entry is found, a keynote in the new chord time interval is determined to be the current keynote. Though this arrangement excludes function generating modules, it still considers chord functions for tonality analysis of a given chord progression within the scope of the invention. In other words, the specific embodiment is designed to save the storage capacity of the functional knowledge database by representing each chord entry in the database with a function name instead of chord (root and type) name.

In place of the scale table SCT of FIG. 21, a modified scale table may be used which stores correspondence between combinations of keynote, type and root, and scales. In operation such modified scale table may be searched for a particular combination of a type and root of an input chord newly supplied from the chord progression input device and a determined keynote of the new chord to obtain a scale suitable for the particular combination.

In place of a real-time performance input device such as a musical keyboard which inputs a chord progression on a real-time basis, a non-real time chord progression input device may be used which inputs a chord progression on a non-real time basis in which each chord is represented by a type, a root and a duration. A memory which stores a progression of chords each represented by a type, a root and a duration may also be used as a chord progression source.

Figure 47:
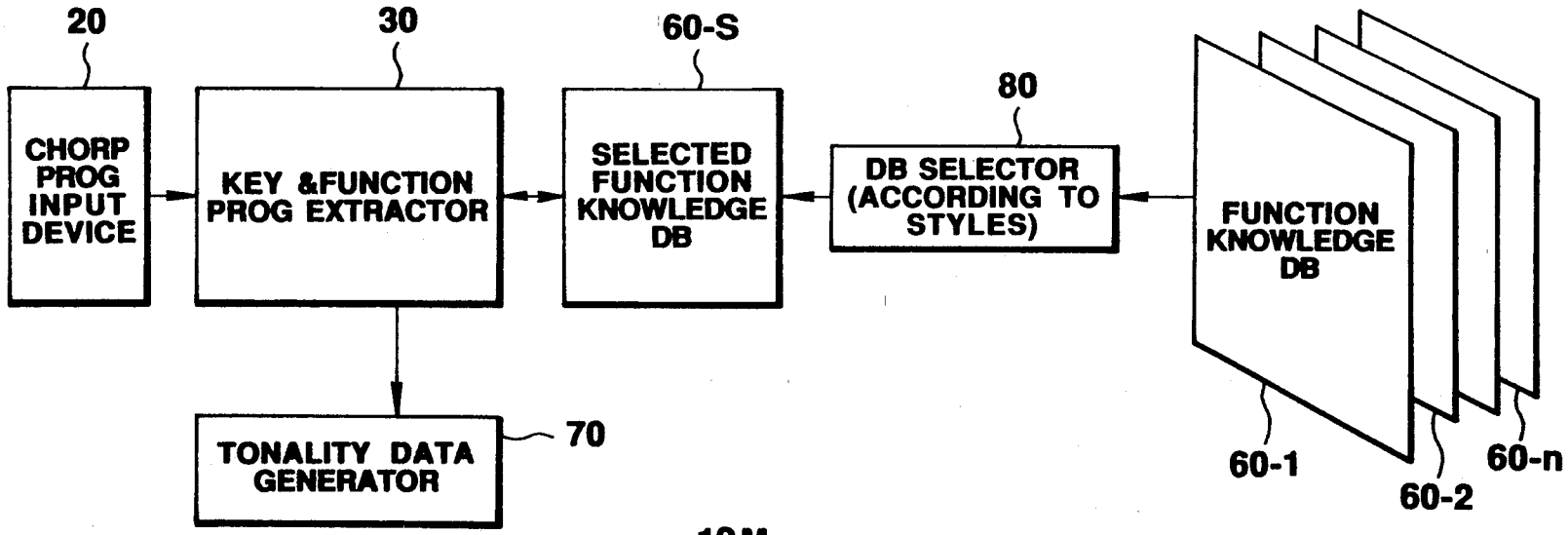
FIG. 47 is a functional block diagram of a tonality determining apparatus which enables selecting of a desired function knowledge database.

Further, as illustrated in FIG. 47, there may be provided a plurality of function knowledge databases 60-1 to 60-n classified according to musical styles. A database selector 80, which may take the form of a musical style selecting input device, selects a desired one 60-S of the plurality of databases 60-1 to 60-n. In operation, the key and function extractor 30 in combination with the tonality data generator 70 analyzes a chord progression from the chord progression input device 20 based on the selected function knowledge database 60-S. This arrangement will provide more satisfactory tonality analysis of a chord progression.

In the specific embodiment, the combination of the reference accompaniment pattern memory AM and the pitch modulating table memory PCT serves as an accompaniment memory which defines a plurality of accompaniment patterns according to chord function names. With this arrangement, a played accompaniment rhythm will not change with chord function names. However it is obvious to provide an accompaniment apparatus capable of changing both the pitch line and rhythm of the played accompaniment with function names. For example, such arrangement employs a reference accompaniment memory which stores reference accompaniment pattern suitable for a reference keynote and function name (or scale) with each pattern member tone being represented by a pitch and a duration (e.g., tone event to event time), a pitch modifying table memory which stores pitch differences each for modifying a pitch from the reference accompaniment pattern memory in accordance with a function name (or scale), and a rhythm modifying table memory which stores duration differences each for modifying a duration from the reference accompaniment pattern memory in accordance with a function name (or scale). In operation, in response to a detected function name (or scale), the accompaniment apparatus modifies the pitch line of the reference accompaniment pattern with pitch difference data in the pitch modifying table memory associated with the detected function name (or scale), and modifies the rhythm of the reference accompaniment pattern with duration difference data in the rhythm modifying table memory associated with the detected function name (or scale) to thereby form an accompaniment pattern having a rhythm and pitch line suitable for the detected chord function name (or scale). In place of pitch difference or duration difference, pitch per se or duration per se may be stored in a pitch data table memory or duration data table memory. In this case, the reference accompaniment pattern memory may be replaced by an attribute memory which stores a column pointer locating a column of the pitch data table memory and a column of the duration data memory with respect to each accompaniment pattern member note. Each individual pitch data and duration data in the pitch data memory and duration data table memory is addressed by the combination of a column pointer from the attribute memory and a row pointer specified by a chord function name (scale). The attribute memory, pitch data memory and duration data memory thus form a link structured accompaniment memory. This technique has the advantage of saving the storage capacity in particular when a long accompaniment pattern is used or when a large number of accompaniment patterns are used in the accompaniment apparatus.

What is claimed is:

1. An apparatus for determining a tonality from a chord progression comprising:

chord progression providing means for providing the chord progression;

current keynote storage means for storing keynote data indicative of a current keynote;

same keynote keeping chord table storage means for storing a set of chords each keeping a keynote unchanged;

same keynote determining means responsive to a new chord from said chord progression providing means for determining whether said same keynote keeping chord table storage means includes a chord having a function identical with a function of said new chord, said function of said new chord being specified by said keynote data stored in said current keynote storage means, and for generating a keynote keeping signal if said same keynote keeping chord table storage means includes said chord; and tonality data producing means responsive to said keynote keeping signal for producing tonality data defining a set of pitch classes available in a time interval of said new chord based on said current keynote and said new chord.

2. The apparatus of claim 1 wherein said chord progression providing means includes means for defining a root and type of said new chord;

wherein each chord stored in said same keynote keeping chord table storage means is represented by a scale degree and a type; and wherein said same keynote determining means comprises chord function generating means for computing a scale degree indicative of a difference between said root of said new chord and said current keynote and for generating a functional representation of said new chord represented by said computed scale degree and said type of said new chord, and search means for searching said same keynote keeping chord table storage means for said generated functional representation.

3. The apparatus of claim 1 wherein said tonality data producing means comprises scale producing means for producing scale data indicative of a scale suitable for said function of said new chord specified by said keynote data, and means for defining said set of pitch classes available in said time interval of said new chord based on said scale and said current keynote.

4. The apparatus of claim 1 further comprising relative key chord sequence storage means for storing a set of chord sequences each indicative of a change from a major key to a relative minor key; and wherein said same keynote determining means includes means operative when said same keynote keeping chord table storage means does not include said chord having said function of said new chord for determining whether said relative key chord sequence storage means includes a chord sequence having a function sequence identical with a function sequence of an old chord immediately preceding said new chord and said new chord from said chord progression, said function sequence of said old chord and said new chord being specified by said current keynote in said current keynote storage means, and for generating a keynote keeping signal if said relative key chord sequence storage means includes said chord sequence.

5. The apparatus of claim 1 further comprising:

modulation chord sequence storage means for storing a set of chord sequences each indicative of a modulation from said current keynote to another keynote;

modulation determining means operative when said same keynote keeping chord table storage means does not include said chord having said function of said new chord for determining whether said modulation chord sequence storage means includes a sequence of chords having a function sequence identical with a function sequence of an old chord immediately preceding said new chord and said new chord, said function sequence of said old chord and said new chord being specified by a different keynote from said current keynote, and for generating a modulation keynote signal indicative of a modulation to said different keynote if said modulation chord sequence storage means includes said sequence of chords; and second tonality data producing means responsive to said modulation keynote signal for producing tonality data defining a set of pitch classes available in said time interval of said new chord based on said different keynote and said new chord; and keynote updating means responsive to said modulation keynote signal for updating said current keynote storage means to said different keynote.

6. The apparatus of claim 1 further comprising:

chord function storage means for storing a set of functional representations of chords;

related keynote generating means operative when said same keynote keeping chord table storage means does not include said chord having said function of said new chord for generating a related keynote signal indicative of a related keynote to said current keynote;

first function generating means for generating a first functional representation of said new chord specified by said related keynote;

second function generating means for generating a second functional representation of an old chord specified by said related keynote, said old chord immediately preceding said new chord in said chord progression;

modulation determining means for determining whether said chord function storage means includes both said first functional representation and said second functional representation and for selectively generating a modulation signal according to results of said determining;

second tonality data producing means responsive to said modulation signal for producing tonality data defining a set of pitch classes available in said time interval of said new chord based on said related keynote and said new chord; and keynote updating means responsive to said modulation signal for updating said current keynote storage means to said related keynote signal.

7. The apparatus of claim 6 further comprising third function generating means for generating a third functional representation of said old chord specified by said current keynote; and wherein said modulation determining means includes means for generating said modulation signal when said chord function storage means includes each of said first functional representation, said second functional representation and said third functional representation.

8. The apparatus of claim 1 further comprising:

chord-to-function table storage means for storing correspondence between chords and functions;

direct conversion means operative when said same keynote keeping chord table storage means does not include said chord corresponding to said new chord in said chord progression for directly converting said new chord to a function by referencing said chord-to-function table storage means;

keynote generating means for generating a keynote according to said converted function;

updating means for updating said current keynote storage means to said generated keynote; and means for producing tonality data defining a set of pitch classes available in said time interval of said new chord based on said generated keynote and said new chord.

9. The apparatus of claim 4 further comprising:

chord-to-function table storage means for storing correspondence between chords and functions;

converting means operative when said same keynote keeping chord table storage means does not include said chord corresponding to said new chord, and said relative key chord sequence storage means does not include said chord sequence corresponding to a pair of said old chord and said new chord for converting said new chord to a function by referencing said chord-to-function table storage means;

keynote generating means for generating a keynote according to said converted function;

updating means for updating said current keynote storage means to said generated keynote; and means for producing tonality data defining a set of pitch classes available in said time interval of said new chord based on said generated keynote and said new chord.

10. The apparatus of claim 5 further comprising:

chord-to-function table storage means for storing correspondence between chords and functions;

converting means operative when said same keynote keeping chord table storage means does not include said chord corresponding to said new chord, and said modulation chord sequence storage means does not include said sequence of chords corresponding to a pair of said old chord and said new chord for converting said new chord to a function by referencing said chord-to-function table storage means;

keynote generating means for generating a keynote according to said converted function;

updating means for updating said current keynote storage means to said generated keynote; and means for producing tonality data defining a set of pitch classes available in said time interval of said new chord based on said generated keynote and said new chord.

11. An apparatus for determining a tonality comprising:

chord progression providing means for providing a chord progression in which each chord is defined by a root and a type;

musical knowledge storage means for storing musical knowledge of correspondence between chord patterns in which each chord is defined by a root and a type, and function name patterns in which each chord is defined by a function and a type;

keynote and function extracting means for extracting a function and keynote of each chord in said chord progression by referencing said musical knowledge storage means;

tonality data producing means responsive to said keynote and function extracting means for producing tonality data defining a set of pitch classes available in a time interval of each chord in said chord progression based on a type, function and keynote of said each chord.

12. An apparatus for determining a tonality comprising:

chord progression providing means for providing a chord progression in which each chord is represented by a root and a type;

database means for storing a database of musical knowledge for evaluating a function of a chord;

analyzing means for analyzing said chord progression based on said database stored in said database means; and tonality data producing means responsive to said analyzing means for producing tonality data defining a set of pitch classes available in a time interval of said each chord in said chord progression.

13. The apparatus of claim 12 wherein said database means includes means for storing information about chord function sequences each keeping a keynote unchanged.

14. The apparatus of claim 12 wherein said database means includes means for storing information about chord function sequences each indicative of a modulation.

15. The apparatus of claim 12 wherein said analyzing means includes means for generating a functional representation of a chord in said chord progression according to a predetermined keynote.

16. An apparatus for determining a tonality comprising:

chord progression providing means for providing a chord progression in which each chord is represented by a root and a type;

current keynote storage means for storing keynote data indicative of a current keynote;

database means for storing a database of musical knowledge for evaluating a function of a chord;

analyzing means for analyzing said chord progression based on said keynote data from said current keynote storage means and said database from said database means to thereby produce a chord function progression; and tonality data producing means for producing tonality data defining a set of pitch classes available in a time interval of each chord in said chord progression based on said chord function progression from said analyzing means.

17. The apparatus of claim 16 wherein said analyzing means comprises:

chord function determining means for determining a function of a new chord from said chord progression based on said keynote data from said current keynote storage means and said database from said database means; and keynote updating means for selectively updating said current keynote storage means according to said function determined by said chord function determining means.

18. An apparatus for automatically performing an accompaniment comprising:

chord progression providing means for providing a chord progression in which each chord is represented by a type and a root;

function and keynote determining means for determining a function and keynote of said each chord in said chord progression; and accompaniment forming means for forming an accompaniment in a time interval of said each chord in said chord progression based on said type, function and keynote of said each chord, wherein said accompaniment forming means comprises:

accompaniment pattern storage means for storing accompaniment tone pitch data arranged to define an accompaniment pattern;

pitch modifying table storage means for storing pitch modifying data for modifying said accompaniment tone pitch data from said accompaniment pattern storage means;

first pitch modifying means for modifying accompaniment tone pitch data from said accompaniment pattern storage means in said time interval of said each chord in said chord progression in accordance with pitch modifying data stored in said pitch modifying table storage means and corresponding to a combination of said function and type of said each chord, and said accompaniment tone pitch data to thereby produce first pitch data; and second pitch modifying means for modifying said first pitch data in accordance with said keynote in said time interval to thereby produce second pitch data indicative of a final accompaniment tone pitch.

19. An apparatus for automatically performing an accompaniment comprising:

chord progression providing means for providing a chord progression in which each chord is represented by a type and a root;

function and keynote determining means for determining a function and keynote of said each chord in said chord progression; and accompaniment forming means for forming an accompaniment in a time interval of said each chord in said chord progression based on said type, function and keynote of said each chord, wherein said accompaniment forming means comprises:

a plurality of accompaniment pattern storage means each for storing an accompaniment pattern for a different one of combinations of a function and a type of a chord;

accompaniment pattern selecting means for selecting one accompaniment pattern storage means from said plurality of accompaniment pattern storage means in accordance with a function and a type of a chord in said chord progression; and pitch modifying means for modifying pitch contents of an accompaniment pattern from said selected accompaniment pattern storage means in accordance with a keynote of said chord in said chord progression.

20. An apparatus for automatically performing an accompaniment comprising:

chord progression providing means for providing a chord progression in which each chord is represented by a type and a root;

function determining means for determining a function of said each chord in said chord progression; and accompaniment forming means for forming an accompaniment in a time interval of said each chord in said chord progression in accordance with a combination of said function, root and type of said each chord, wherein said accompaniment forming means comprises:

keynote generating means for generating a keynote of said each chord in said chord progression from said root and said function of said each chord;

accompaniment pattern generating means for generating an accompaniment pattern suitable for said function and said type of said each chord in said chord progression; and modifying means for modifying pitch contents of said generated accompaniment pattern in accordance with said keynote from said keynote generating means.

21. An apparatus for automatically performing an accompaniment comprising:

chord progression providing means for providing a chord progression in which each chord is represented by a type and a root;

function and keynote determining means for determining a function and keynote of said each chord in said chord progression; and accompaniment forming means for forming an accompaniment in a time interval of said each chord in said chord progression based on said type, function and keynote of said each chord, wherein said accompaniment forming means comprises:

accompaniment pattern generating means for generating a pattern of pitch interval data indicative of a pitch interval from a keynote in accordance with a type from said chord progression providing means and a function from said function and keynote determining means; and pitch generating means for combining keynote data indicative of a keynote from said function and keynote determining means and pitch interval data from said accompaniment pattern generating means to thereby generate a pitch of an accompaniment tone.

22. An apparatus for automatically performing an accompaniment comprising:

chord progression providing means for providing a chord progression in which each chord is represented by a type and a root;

function and keynote determining means for determining a function and keynote of said each chord in said chord progression;

group defining means for defining a first chord group and a second chord group;

first accompaniment forming means for forming an accompaniment in a time interval of a first chord in said chord progression which pertains to said first chord group by using results from said function and keynote determining means; and second accompaniment forming means for forming an accompaniment in a time interval of a second chord in said chord progression which pertains to said second chord group without using said results from said function and keynote determining means.

23. The apparatus of claim 22 wherein said first accompaniment forming means comprises:

first accompaniment pattern generating means for generating a pattern of pitch interval data indicative of a pitch interval from a keynote in accordance with a type of said first chord from said chord progression providing means and a function of said first chord from said function and keynote determining means; and first pitch generating means for combining keynote data indicative of a keynote from said function and keynote determining means and pitch interval data from said first accompaniment pattern generating means to thereby generate a pitch of an accompaniment tone; and wherein said second accompaniment forming means comprises:

second accompaniment pattern generating means for generating a pattern of pitch interval data indicative of a pitch interval from a root in accordance with a type of said second chord from said chord progression providing means; and second pitch generating means for combining root data indicative of a root of said second chord from said chord progression providing means and pitch interval data from said second accompaniment pattern generating means to thereby generate a pitch of an accompaniment tone.

24. The apparatus of claim 22 wherein said first accompaniment forming means comprises:

first accompaniment pattern generating means for generating a pattern of pitch interval data indicative of a pitch interval from a root in accordance with a type of said first chord from said chord progression providing means and a function of said first chord from said function and keynote determining means; and first pitch generating means for combining root data indicative of a root of said first chord from said chord progression providing means and pitch interval data from said first accompaniment pattern generating means to thereby generate a pitch of an accompaniment tone; and wherein said second accompaniment forming means comprises:

second accompaniment pattern generating means for generating a pattern of pitch interval data indicative of a pitch interval from a root in accordance with a type of said second chord from said chord progression providing means; and second pitch generating means for combining root data indicative of a root of said second chord from said chord progression providing means and pitch interval data from said second accompaniment pattern generating means to thereby generate a pitch of an accompaniment tone.

25. An apparatus for automatically performing an accompaniment comprising:

chord progression providing means for providing a chord progression in which each chord is represented by a root and a type;

database means for storing a database of musical knowledge for evaluating a function of a chord;

analyzing means for analyzing said chord progression based on said database stored in said database means;

tonality data producing means responsive to said analyzing means for producing tonality data defining a set of pitch classes available in a time interval of each chord in said chord progression; and accompaniment forming means for forming an accompaniment based on tonality data from said tonality data producing means.

26. An apparatus for automatically performing an accompaniment comprising:

chord progression providing means for providing a chord progression;

current keynote storage means for storing keynote data indicative of a current keynote;

same keynote keeping chord table storage means for storing a set of chords each keeping a keynote unchanged;

same keynote determining means responsive to a new chord from said chord progression providing means for determining whether said same keynote keeping chord table storage means includes a chord having a function identical with a function of said new chord, said function of said new chord being specified by said keynote data stored in said current keynote storage means, and for generating a keynote keeping signal if said same keynote keeping chord table storage means includes said chord;

tonality data producing means responsive to said keynote keeping signal for producing tonality data defining a set of pitch classes available in a time interval of said new chord based on said current keynote and said new chord; and accompaniment forming means for forming an accompaniment in said time interval of said new chord based on said tonality data from said tonality data producing means.

27. An apparatus for automatically performing an accompaniment comprising:

chord progression providing means for providing a chord progression in which each chord is defined by a root and a type;

musical knowledge storage means for storing musical knowledge of correspondence between chord patterns in which each chord is defined by a root and a type, and function name patterns in which each chord is defined by a function and a type;

keynote and function extracting means for extracting a function and keynote of each chord in said chord progression by referencing said musical knowledge storage means;

tonality data producing means responsive to said keynote and function extracting means for producing tonality data defining a set of pitch classes available in a time interval of each chord in said chord progression based on a type, function and keynote of said each chord; and accompaniment forming means for forming an accompaniment based on tonality data from said tonality data producing means.

28. An apparatus for determining a tonality from a chord progression comprising:

chord progression providing means for providing the chord progression;

current keynote storage means for storing keynote data indicative of a current keynote;

modulation chord sequence storage means for storing information about a set of chord sequences each indicative of a modulation;

modulation detecting means responsive to a new chord from said chord progression providing means for selectively detecting a modulation from said current keynote to a different keynote by referencing said modulation chord sequence storage means to thereby generate a modulation keynote signal;

tonality data producing means responsive to said modulation keynote signal from said modulation detecting means for producing tonality data defining a set of pitch classes available in a time interval of said new chord based on said different keynote and said new chord; and keynote updating means responsive to said modulation keynote signal from said modulation detecting means for updating said current keynote storage means to said different keynote.

29. An apparatus for determining a keynote of a chord from a chord progression comprising:

chord progression providing means for providing the chord progression;

current keynote storage means for storing keynote data indicative of a current keynote;

modulation chord sequence storage means for storing information about a set of chord sequences each indicative of a modulation;

modulation detecting means responsive to a new chord from said chord progression providing means for selectively detecting a modulation from said current keynote to a different keynote by referencing said modulation chord sequence storage means to thereby generate a modulation keynote signal;

keynote updating means responsive to said modulation keynote signal from said modulation detecting means for updating said current keynote storage means to said different keynote.

30. An apparatus for automatically performing an accompaniment comprising:

chord progression providing means for providing a chord progression in which each chord is represented by a root and a type;

database means for storing a database of musical knowledge for evaluating a function of a chord, said database means including means for storing information about chord function sequences each keeping a keynote unchanged; analyzing means for analyzing said chord progression based on said database stored in said database means;

tonality data producing means responsive to said analyzing means for producing tonality data defining a set of pitch classes available in a time interval of said each chord in said chord progression; and accompaniment forming means for forming an accompaniment based on tonality data from said tonality data producing means.

31. An apparatus for automatically performing an accompaniment comprising:

chord progression providing means for providing a chord progression in which each chord is represented by a root and a type;

database means for storing a database of musical knowledge for evaluating a function of a chord, said database means including means for storing information about chord function sequences each indicative of a modulation;

analyzing means for analyzing said chord progression based on said database stored in said database means;

tonality data producing means responsive to said analyzing means for producing tonality data defining a set of pitch classes available in a time interval of said each chord in said chord progression; and accompaniment forming means for forming an accompaniment based on tonality data from said tonality data producing means.

32. An apparatus for automatically performing an accompaniment comprising:

chord progression providing means for providing a chord progression in which each chord is represented by a root and a type;

database means for storing a database of musical knowledge for evaluating a function of a chord;

analyzing means for analyzing said chord progression based on said database stored in said database means, said analyzing means including means for generating a functional representation of a chord in said chord progression according to a predetermined keynote;

tonality data producing means responsive to said analyzing means for producing tonality data defining a set of pitch classes available in a time interval of said each chord in said chord progression; and accompaniment forming means for forming an accompaniment based on tonality data from said tonality data producing means.

* * * * *